US010139175B1

(12) United States Patent
Redmon et al.

(10) Patent No.: US 10,139,175 B1
(45) Date of Patent: Nov. 27, 2018

(54) GAS OPERATED MACHINE GUN

(71) Applicants: Christopher M. Redmon, Tampa, FL (US); Derek A. Redmon, Tampa, FL (US)

(72) Inventors: Christopher M. Redmon, Tampa, FL (US); Derek A. Redmon, Tampa, FL (US)

( * ) Notice: Subject to any disclaimer, the term of this patent is extended or adjusted under 35 U.S.C. 154(b) by 0 days.

(21) Appl. No.: 15/731,026

(22) Filed: Apr. 7, 2017

Related U.S. Application Data

(62) Division of application No. 14/121,627, filed on Sep. 29, 2014, now Pat. No. 9,618,290.

(60) Provisional application No. 61/961,458, filed on Oct. 15, 2013.

(51) Int. Cl.

| | |
|---|---|
| ***F41A 21/20*** | (2006.01) |
| ***F41A 9/04*** | (2006.01) |
| ***F41A 9/76*** | (2006.01) |
| ***F41A 5/18*** | (2006.01) |
| ***F41A 3/26*** | (2006.01) |
| ***F41A 19/44*** | (2006.01) |
| ***F41A 19/46*** | (2006.01) |

(52) U.S. Cl.
CPC *F41A 9/04* (2013.01); *F41A 3/26* (2013.01); *F41A 5/18* (2013.01); *F41A 9/76* (2013.01); *F41A 19/44* (2013.01); *F41A 19/46* (2013.01)

(58) Field of Classification Search
CPC ..... F41A 3/26; F41A 3/40; F41A 5/18; F41A 5/20; F41A 5/22; F41A 5/24; F41A 5/30; F41A 7/56; F41A 7/58; F41A 9/04; F41A 9/05; F41A 9/76; F41A 19/44; F41A 19/46
USPC ..... 89/128, 132, 149, 150, 191.01, 191.02, 89/192, 33.01, 33.02, 33.1
See application file for complete search history.

(56) References Cited

U.S. PATENT DOCUMENTS 2,468,074 A * 4/1949 Janson, Jr. ..... F41A 9/30 74/126
2,872,849 A * 2/1959 Simpson ..... F41A 19/03 89/140
3,122,967 A * 3/1964 Johnson ..... F41A 9/01 89/46
3,618,455 A * 11/1971 Plumer ..... F41A 17/16 89/132

(Continued)

*Primary Examiner* — Bret Hayes
(74) *Attorney, Agent, or Firm* — Arthur W. Fisher, III

(57) ABSTRACT

An automatic weapon system comprising a bolt driven gas operated machine gun operable in either an open bolt configuration or a closed bolt configuration including a reciprocating bolt assembly operable in either a semi-automatic mode or an automatic mode movable between a rear or open position and a forward or closed position and a firing chamber in combination with an ammunition magazine to automatically feed cartridges from the ammunition magazine to the gas operated machine gun for continuous fire of cartridges from the automatic weapon system including a cartridge feed mechanism to convert the linear motion of the reciprocating bolt assembly into rotary motion to incrementally position a cartridge from the ammunition magazine through a cartridge feed opening formed in the ammunition magazine into the firing chamber as the reciprocating bolt assembly moves between the rear or open position to the forward or closed position.

9 Claims, 35 Drawing Sheets

(56) References Cited

U.S. PATENT DOCUMENTS

| | | | | |
|---|---|---|---|---|
| 3,955,469 | A * | 5/1976 | Conley | F41A 9/32<br>89/33.14 |
| 5,335,581 | A * | 8/1994 | Simon | F41A 9/02<br>89/156 |
| 7,806,039 | B1 * | 10/2010 | Gomez | F41A 17/42<br>89/132 |
| 2004/0069137 | A1 * | 4/2004 | Jebsen | F41A 3/56<br>89/198 |
| 2007/0266845 | A1 * | 11/2007 | Polston | F41A 19/33<br>89/139 |
| 2012/0144712 | A1 * | 6/2012 | Rostocil | F41A 9/79<br>42/16 |
| 2013/0118343 | A1 * | 5/2013 | Hirt | F41A 19/06<br>89/149 |
| 2014/0109451 | A1 * | 4/2014 | Beckman | F41A 9/27<br>42/1.02 |

* cited by examiner

GAS OPERATED MACHINE GUN

CROSS-REFERENCE

This is a divisional application claiming of co-pending application Ser. No. 14/121,627 filed Sep. 29, 2014 which claims priority of provisional application No. 61/961,458 filed Oct. 15, 2013.

BACKGROUND OF THE INVENTION

Field of the Invention

An automatic weapon system comprising a bolt driven gas operated machine gun and an ammunition magazine including a continuous feed chain to feed cartridges to the gas operated machine gun for continuous fire.

Description of the Prior Art

Various automatic weapons or machine guns and ammunition magazines have been designed to continuously feed cartridges to an automatic weapon or machine gun for rapid fire. A number of these designed are described in the prior art discussed below.

U.S. Pat. No. 6,405,629 relates to an ammunition magazine for beltless fed ammunition comprising endless ammunition. To prevent slack from developing a chain tightener is provided with a brake to influence a spring constant of the chain tightener as a function of the direction of tightening and the speed of the clamping movement.

U.S. Pat. No. 6,389,948 discloses an ammunition feed device an endlessly guided ammunition feed chain to feed ammunition into the weapon and at least two deflection units to guide the ammunition feed chain.

U.S. Pat. No. 5,768,815 relates to an extractor for a firearm which incorporates internal extraction to withdraw a cartridge from the chamber of the firearm comprising an outwardly extending lip for engagement in a cavity defined in the rear of the cartridge. The cavity includes an inwardly extending flange and the lip of the extractor is positioned behind the flange during extraction. The extractor includes a first pivot point about which the extractor rotates in order to allow the extractor lip to enter the cartridge cavity. The extractor also includes a second pivot point about which the extractor exerts a positive rotational force to extract the cartridge from the chamber.

U.S. Pat. No. 5,675,110 shows an ammunition feed system comprising a double ammunition rack for different munitions, a loading device to load the munitions one by one and an intermediate device to transfer the munitions from the rack towards the loading device. Each rack comprises a conveyor having two endless chains which is selectively coupled to a star-wheel which forms the intermediate transfer device. This wheel may revolve in two opposite direction in order to extract the munitions from one rack or to bring the munitions back to the original rack.

U.S. Pat. No. 5,594,192 describes an ammunition magazine comprising an endless ammunition conveyor running in a serpentine path including a succession of units consisting of a pair of rigidly connected tubes that receive ammunition rounds in snug-fitting relation. The tubes are pivotally interconnected by links of a single conveyor chain driven by plural drive sprockets to index the tubes to a single magazine port through which uploading/downloading of ammunition rounds is conducted. Guide rollers, fitted on the tubes at positions laterally spaced from the conveyor chain, roll on horizontal tracks within the magazine to provide conveyor support and guidance.

U.S. Pat. No. 5,499,569 teaches an M16 type rifle capable of being fired in automatic or semiautomatic mode utilizing a blow-back system with a forcing cone breech and a matching conical bolt face. The blowback bolt assembly allows elimination of the gas operating system of the conventional M16 rifle. In addition, this allows the rifle to be chambered for short low-pressure pistol cartridges such as the 45 ACP and the 40 S&W.

U.S. Pat. No. 5,147,972 relates to an ammunition feed system wherein a single layer of ammunition is conveyed in a magazine by two independent closed loop conveyors disposed side by side in parallel serpentine paths. Live rounds are fed on parallel output paths into first and second expansion rotor systems which, in turn, supply the rounds to a pair of feed rotors which insert the rounds alternately into a gun feeding conveyor. Spent rounds are withdrawn from the conveyor by a pair of return rotors, which, in turn, supply third and fourth expansion rotors, which return the spent rounds to the first and second parallel serpentine paths. The feed and return rotors contain pockets for receiving rounds alternating with surfaces for guiding rounds and cooperate with the expansion rotors to double the rate at which ammunition exits the system over that at which it is transferred out of the magazine. Rounds are further positively guided by rotor guide surfaces and auxiliary guiding surfaces during handling by the rotor systems between the magazine and gun feeding conveyor.

U.S. Pat. No. 4,876,940 shows an ammunition storage container or magazine comprising an endless ladder-type ammunition conveyor arranged in a serpentine formation consisting of a plurality of straight line path sections and interconnecting, tightly folded turnaround path sections. The conveyor includes a succession of closely spaced ammunition round carriers. Each such carrier comprises a pair of opposed, pivotally interconnected carrier halves configured to automatically assume closed, ammunition round retentive relative positions while disposed in the straight line conveyor path sections and to automatically assume opened, ammunition round releasing relative positions while in the conveyor turnaround path sections.

U.S. Pat. No. 4,522,105 discloses a semiautomatic firing mechanism for an autoloading firearm. A generally C-shaped hammer is pivotably mounted behind a bolt, with a transversely-extending sear piece located below the rearwardly-facing open side of the hammer. The open ends of the hammer provide ledges to selectively engage the primary and secondary sear surfaces on the sear piece.

U.S. Pat. No. 2,180,741 shows a magazine clip comprising a support member, a plurality of parallel rails extending therefrom opposed flanges along each rail, rows of cartridges between the several rails, the cartridge cases of adjacent rows being in contact with one another, the cases each having a groove in its base end engaged by the flanges and having a flange of a diameter less than the diameter of the case engaged between adjacent rails.

U.S. Pat. No. 2,031,433 teaches an automatic small arm ammunition loading device comprising in combination with a breech bolt an endless band conveyor for feeding the cartridges ratchets secured to the band, one for each cartridge, a pawl adapted to engage the ratchets to push the endless band conveyor forward.

U.S. Pat. No. 1,552,863 relates to an apparatus for automatically loading small caliber guns actuated by the recoil comprising an endless conveyor or chain of buckets or troughs disposed transversely to the longitudinal axis of the gun so that the troughs on the underside of the conveyor form housings to receive over an automatic distributor. The distributor positions the projectile in line with the bore of the gun and the ramming breech block to be rammed into the bore of the gun.

U.S. Pat. No. 1,504,714 shows a machine gun mounting bracket detachably secured thereto, a hopper feed box detachably held on the bracket and having a cartridge outlet opposite the feed way. A rotatable cartridge feeding wheel is disposed between the cartridge outlet and feed way with means controlled by the cartridge feeding means of the gun for rotating the wheel to transfer the cartridges from the feed box to the gun feed way comprising a rack and pinion mechanism.

US 2005/0011346 shows a carrier assembly for a gun comprising a gun bolt carrier disposed to reciprocate axially with respect to the central axis of the gun and a gun bolt disposed to reciprocate axially within the carrier. The gun bolt has a locking groove therein. The assembly also comprises a bolt locking mechanism extending through a portion of the bolt carrier to selectively engage the locking groove and thereby prevent the bolt from moving with respect to the carrier. The assembly further comprises a generally axial groove in a non-reciprocating portion of the gun that engages and selectively rotates the rotatable bolt locking mechanism to selectively lock the bolt to the carrier.

US 2010/0186581 refers to a semi-automatic shotgun including a receiver having an ejection port for expelling an empty cartridge of a fired projectile. The action system includes a bolt attached to a bolt carrier wherein the bolt and the bolt carrier are movable within the receiver and substantially parallel to a longitudinal axis. A surface is attached to at least the bolt carrier or the receiver and a roller is positioned rearward of the ejection port and proximate the surface wherein a resistance is provided to rearward movement of at least the bolt or bolt carrier.

US 2010/028064 relates to a locking systems for use with a firearm comprising a breechblock carrier and a lock spring mechanism that includes a piston. The breechblock carrier is configured to interaction with the piston. Additionally, the example locking system includes a first aperture. The piston is configured to expel fluid through the first aperture when the breechblock carrier retracts.

Additional examples of the prior art are found in U.S. Pat. No. 1,332,060; U.S. Pat. No. 1,903,288; U.S. Pat. No. 2,377,828; U.S. Pat. No. 2,466,578; U.S. Pat. No. 2,522,457; U.S. Pat. No. 3,060,809; U.S. Pat. No. 3,153,368; U.S. Pat. No. 3,596,556; U.S. Pat. No. 3,999,461; U.S. Pat. No. 4,061,074; U.S. Pat. No. 4,066,000; U.S. Pat. No. 5,149,909; U.S. Pat. No. 5,151,556; U.S. Pat. No. 5,571,984; U.S. Pat. No. 6,345,562; U.S. Pat. No. 6,401,592; U.S. Pat. No. 6,681,677 and U.S. Pat. No. 7,040,213.

SUMMARY OF THE INVENTION

The present invention relates to an automatic weapon system operable in either a semi-automatic mode or an automatic mode comprising a bolt driven gas operated machine gun operable in either an open bolt configuration or closed a bolt configuration and an ammunition magazine to feed a cartridge from the ammunition magazine to the gas operated machine gun after each firing.

The ammunition magazine may comprise a magazine housing configured to operatively house a cartridge support assembly to support and retain a plurality of cartridge and a cartridge feed mechanism to incrementally move the cartridge support assembly and the plurality of cartridges through the ammunition magazine to supply a cartridge to the gas operated machine gun upon each firing.

The cartridge support assembly comprises a plurality of cartridge supports disposed in spaced relationship relative to each other on a continuous feed belt. Adjacent cartridge supports are spaced apart to support a cartridge thereon.

The bolt driven gas operated machine gun comprises an upper receiver and lower receiver. The upper receiver includes a barrel assembly, a firing chamber, a bolt assembly and a bolt assembly positioning mechanism; while, the lower receiver includes a firing mechanism and a sear assembly.

The barrel assembly comprises a barrel having a firing chamber positioning assembly to control the rotational position of the firing chamber relative to the bolt assembly and barrel during operation of the bolt driven gas operated machine gun.

The bolt assembly includes a bolt and a bolt carrier to operate in combination with a firing chamber during the firing phase. The bolt comprises a bolt body having a plurality of keys or lugs formed on the distal end portion thereof to selectively engage a corresponding plurality of notches or keyways formed in the firing chamber to lock the bolt and the firing chamber together during firing of the bolt driven gas operated machine gun.

The firing mechanism comprises a hammer member and a trigger member to control of the operation of the hammer member during operation of the gas operated machine gun.

The sear assembly comprises a hammer sear subassembly to selectively engage the hammer when operating in the semi-automatic mode; and a bolt sear subassembly to selectively engage a portion of the bolt assembly when operating in the automatic mode.

When using the continuous feed belt, a gun feed mechanism and a magazine feed assembly cooperatively translate the linear movement of the bolt during the operating cycle of the bolt driven gas operated machine gun to rotary movement to move the continuous feed belt through the ammunition magazine to feed cartridges to the bolt assembly through a cartridge feed aperture.

In operation, the bolt assembly is moved reciprocally fore and aft or proximal and distal positions by the bolt assembly positioning mechanism rotating the firing chamber, locking and unlocking the bolt and firing chamber as the trigger is pulled when operating in the semi-automatic mode or the trigger is held back when operating in the automatic mode.

Specifically, the explosive gas from the cartridge drives the bullet through the barrel. At the same time, the gas pressure forces the bolt assembly rearward. An extractor pulls the shell from the firing chamber as the bolt assembly travels rearward and an ejector forces the shell from the bolt driven gas operated machine gun. A cartridge from the ammunition magazine is then aligned in front of the bolt as a spring or bias pushes the bolt assembly forward, repeating the cycle. When operating in the automatic mode, the successive firing of cartridge continues as long as the trigger is actuated there is ammunition in the ammunition magazine.

Due to the rigors and heat generated during continuous firing particularly in the automatic mode, the barrel and upper receiver may be constructed of carbon ceramic material for improved strength and heat dissipation properties.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
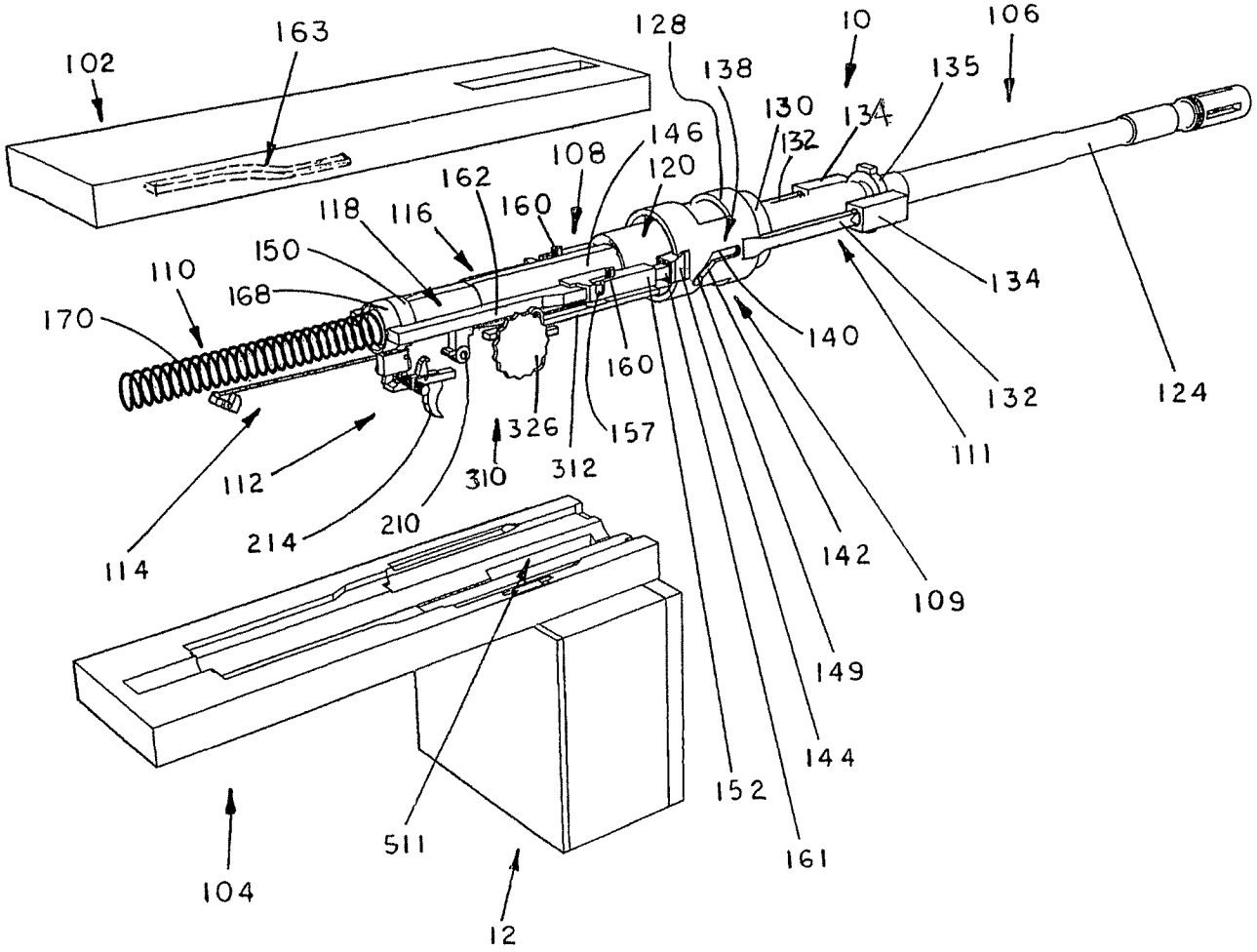
FIG. 1 is an exploded perspective view of the piston driven gas operated machine gun and ammunition magazine of the present invention.

As shown FIG. 1, the present invention relates to an automatic weapon system operable in a semi-automatic mode or an automatic mode comprising a bolt driven gas operated machine gun operable in either an open bolt configuration or a closed bolt configuration generally indicated as 10 and an ammunition magazine generally indicated as 12 to feed a cartridge from the ammunition magazine 12 to the gas operated machine gun 10 after each firing.

The gas operated machine gun 10 comprises a barrel assembly 106 and a bolt assembly 108 including a bolt 116 and bolt carrier or carriage 118 in combination with a firing chamber 120. With a cartridge 22 in the firing chamber 120 the trigger 214 is pulled releasing the hammer 210 to actuate a firing pin (not shown) to ignite the propellant within the cartridge 22.

The explosive gas from the propellant drives the bullet forward through the barrel 124. In addition, the gas pressure acts to force or drive the bolt 116 and bolt carriage 118 rearward. An extractor pulls the empty shell from the firing chamber 120 as the bolt 116 travels rearward and an ejector forces the shell from the gas operated machine gun 10. A new cartridge 22 is aligned in front of the bolt 116 as the spring driven mechanism 110 pushes the bolt 116 forward, starting the loading and ejecting sequence again. When operating in the automatic mode, this continues as long as the trigger 214 is held down and there is a supply of ammunition in the ammunition magazine 12.

Figure 2:
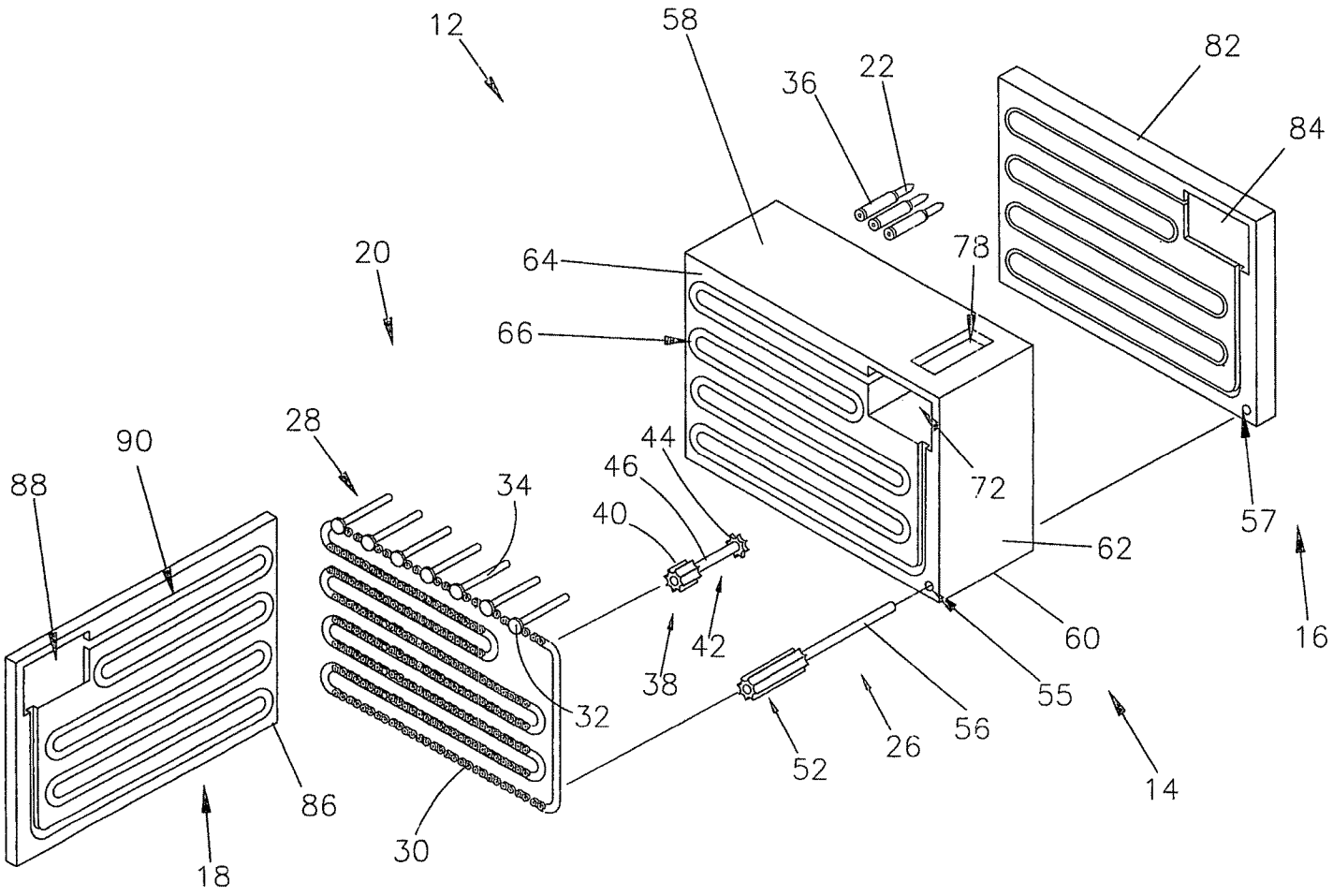
FIG. 2 is an exploded perspective view of the ammunition magazine of the present invention.

As shown in FIG. 2, the ammunition magazine 12 may comprise a magazine housing including a center cartridge housing, a front cover and a rear cover generally indicated as 14, 16 and 18 respectively. As described hereinafter, the ammunition magazine 12 is configured to operatively house a cartridge support assembly generally indicated as 20 to support and retain a plurality of cartridges each indicated as 22 and a magazine feed mechanism including an upper magazine drive mechanism generally indicated as 24 and a lower directional control idler mechanism generally indicated as 26 to incrementally move the cartridge support assembly 20 and the plurality of cartridges 22 through the ammunition magazine 12 to supply a cartridge 22 to the bolt driven gas operated machine gun 10 upon each firing thereof.

The cartridge support assembly 20 comprises a plurality of cartridge supports each generally indicated as 28 disposed in spaced relationship relative to each other on a continuous feed belt or flexible element 30 in the form of a sinusoidal loop. Each cartridge support 28 comprises an enlarged convex or substantially circular guide member 32 having an elongated rod or member 34 extending outwardly therefrom. Adjacent cartridge supports 28 are spaced apart such that adjacent elongated rods or members 34 engage and support the casing 36 of a cartridge 22 therebetween.

Figure 3:
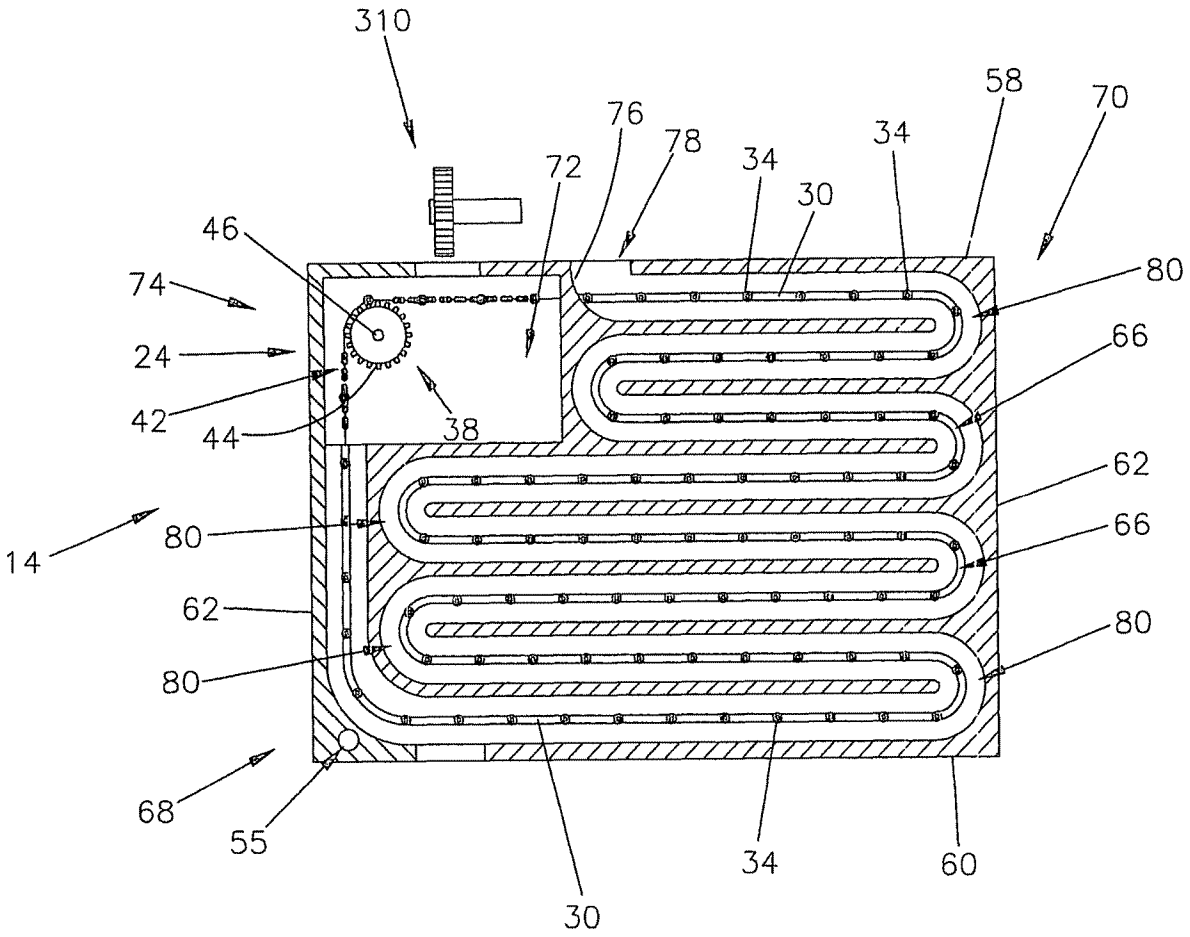
FIG. 3 is a front view of the center cartridge housing of the ammunition magazine of the present invention.
Figure 4:
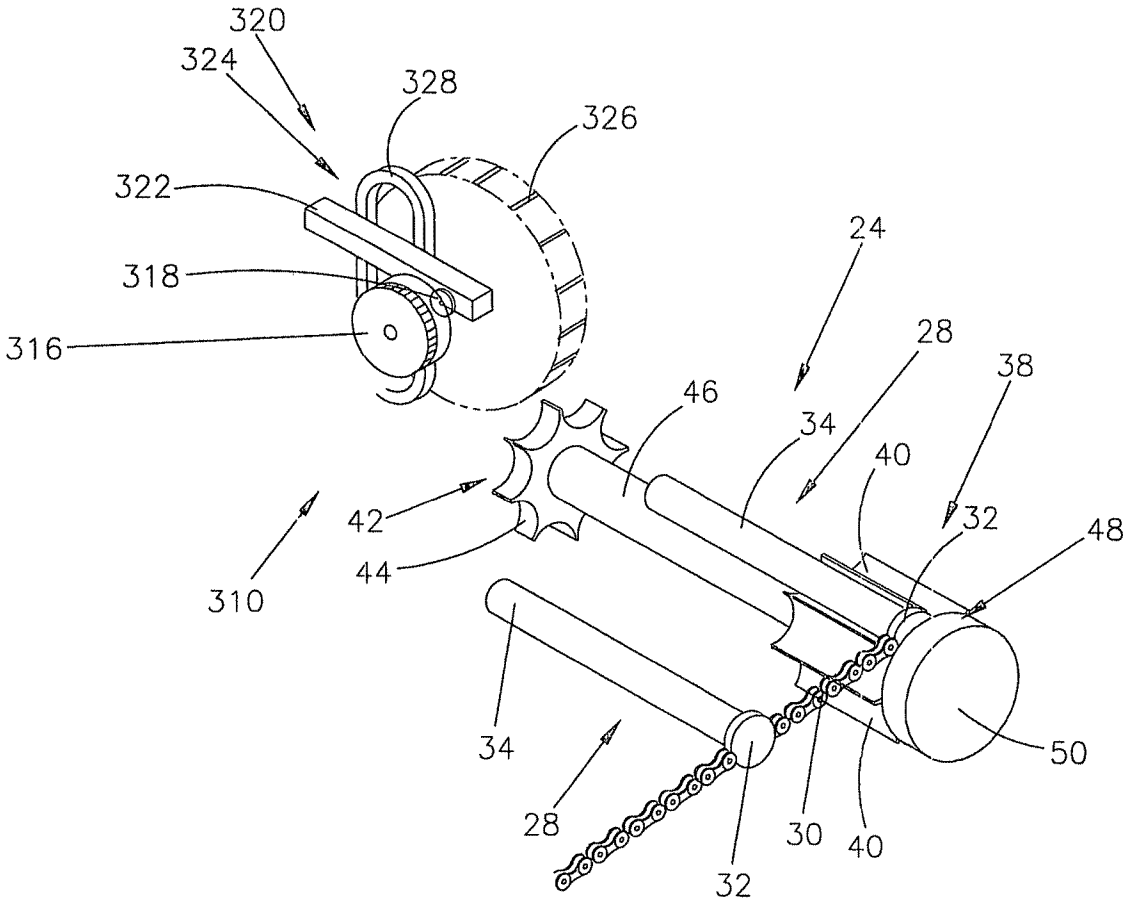
FIG. 4 is a partially detailed perspective view of the upper drive mechanism of the cartridge feed assembly of the present invention.

As shown in FIGS. 3 and 4, the upper magazine drive mechanism 24 comprises a drive drum generally indicated as 38 having a plurality of concave recesses or channels each indicated as 40 to receive and support the elongated rods or members 34 coupled to a gear assembly generally indicated as 42 of the upper magazine drive mechanism 24 of the magazine feed mechanism including at least one magazine drive gear 44 to rotate a drive shaft 46 coupled to the drive drum 38 disposed in substantially parallel relationship relative to the elongated rods or member 34. The drive drum 38 is disposed to change the direction of travel or advancement of the continuous feed belt or flexible element 30 from the horizontal direction to the vertical direction as cartridges 22 are fed from the ammunition magazine 12 to the bolt driven gas operated machine gun 10. The magazine drive gear 44 is disposed to engage a gun fed mechanism of the bolt driven gas operated machine gun 10 to rotate the drive drum 38 to incrementally advance the continuous feed belt or flexible element 30 to position the next cartridge 22 in succession to be fed from the ammunition magazine 12 to the gas operated machine gun 10.

As shown in FIG. 4, a groove or space 48 is formed between the inner end of each concave recess or channel 40 and an enlarged drum cap or flange 50 to receive the enlarged convex or substantially circular guide members 32 of the corresponding elongated rods or members 34 disposed in the recesses or channels 40 as the drive drum 38 rotates driving or advancing the continuous feed belt or flexible element 30 through the ammunition magazine 12.

Figure 5:
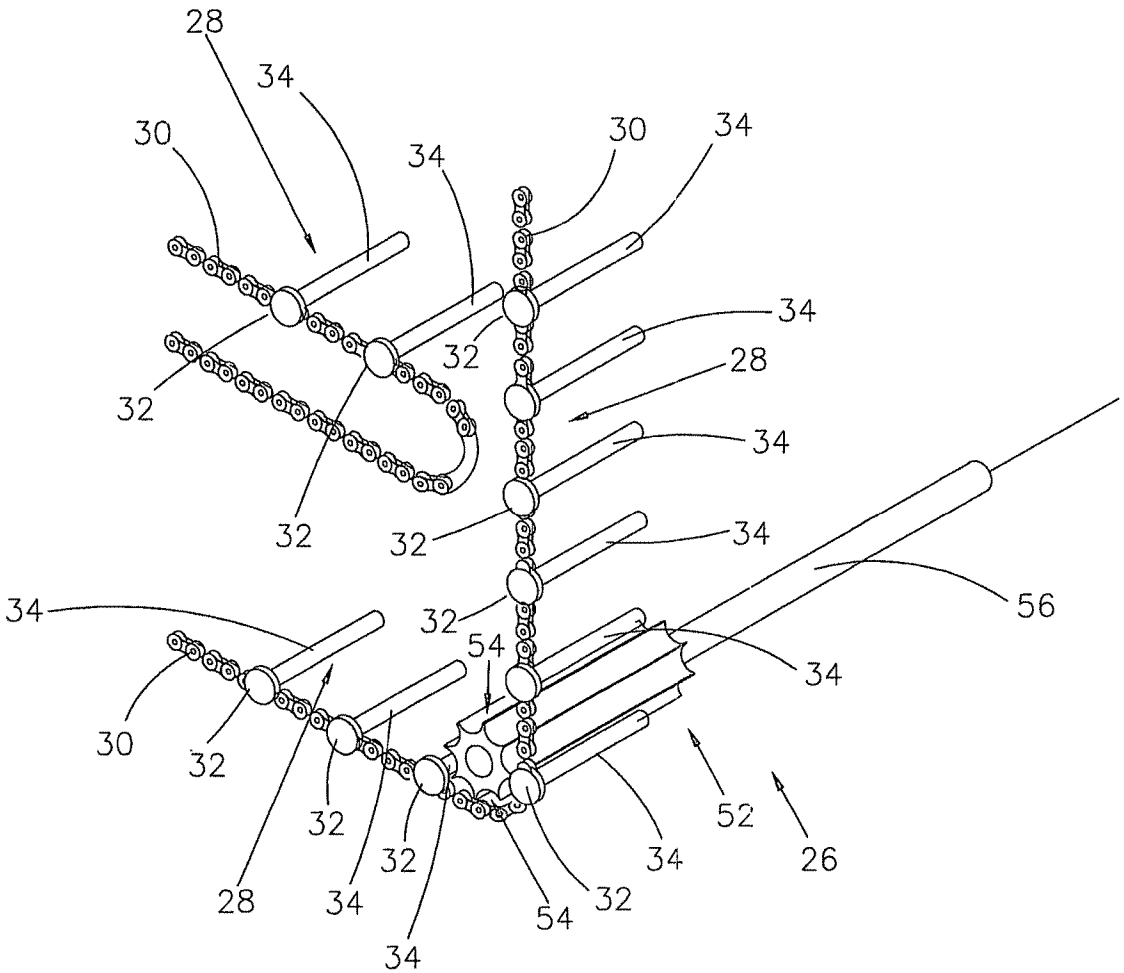
FIG. 5 is a partial detailed perspective view of the lower directional control idler mechanism of the magazine feed assembly of the present invention.
Figure 6:
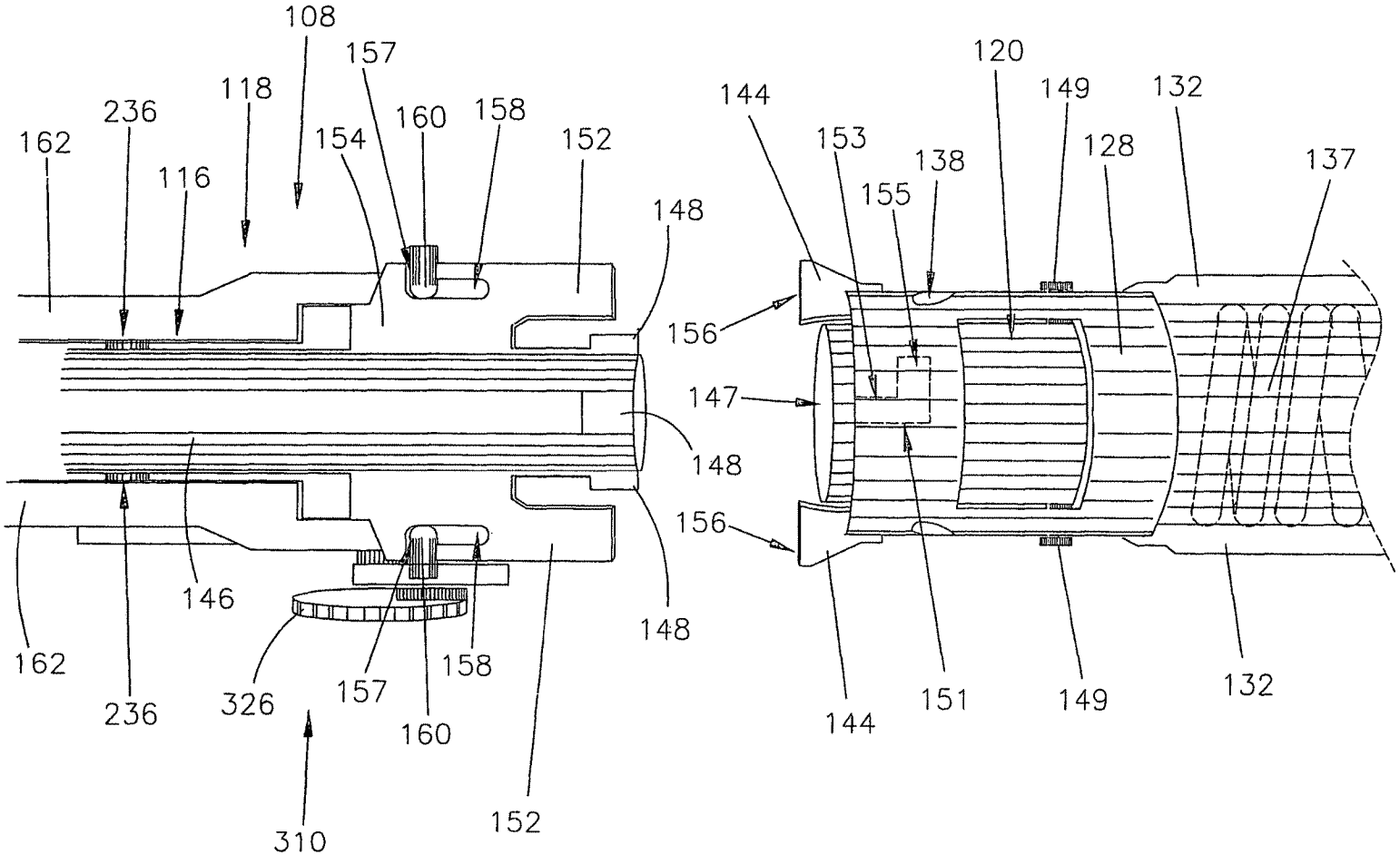
FIG. 6 is a partial top view of the piston driven gas operated machine gun of the present invention.
Figure 7:
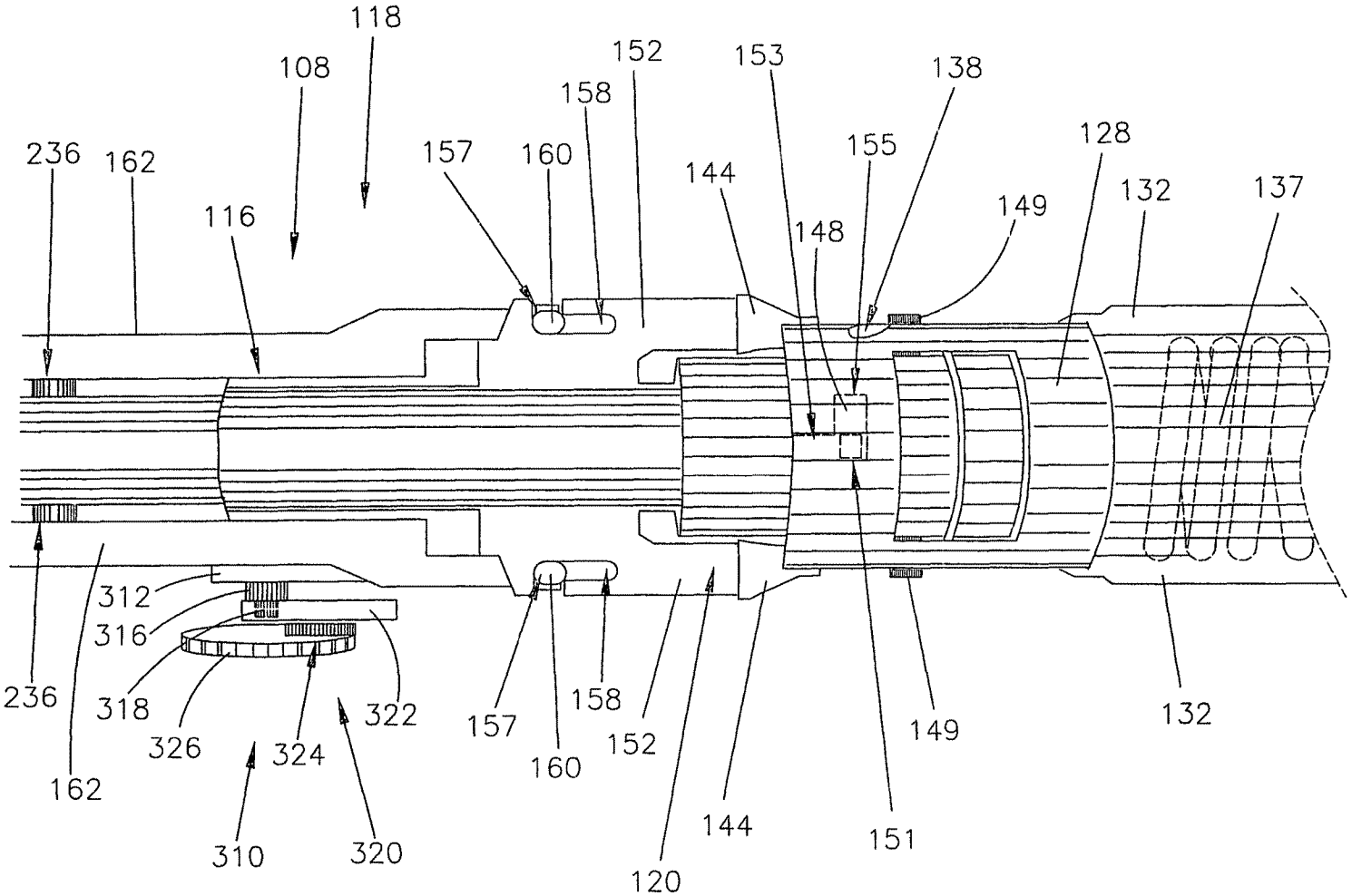
FIG. 7 is a partial top view of the piston driven gas operated machine gun of the present invention with the bolt and firing chamber closed and unlocked.
Figure 8:
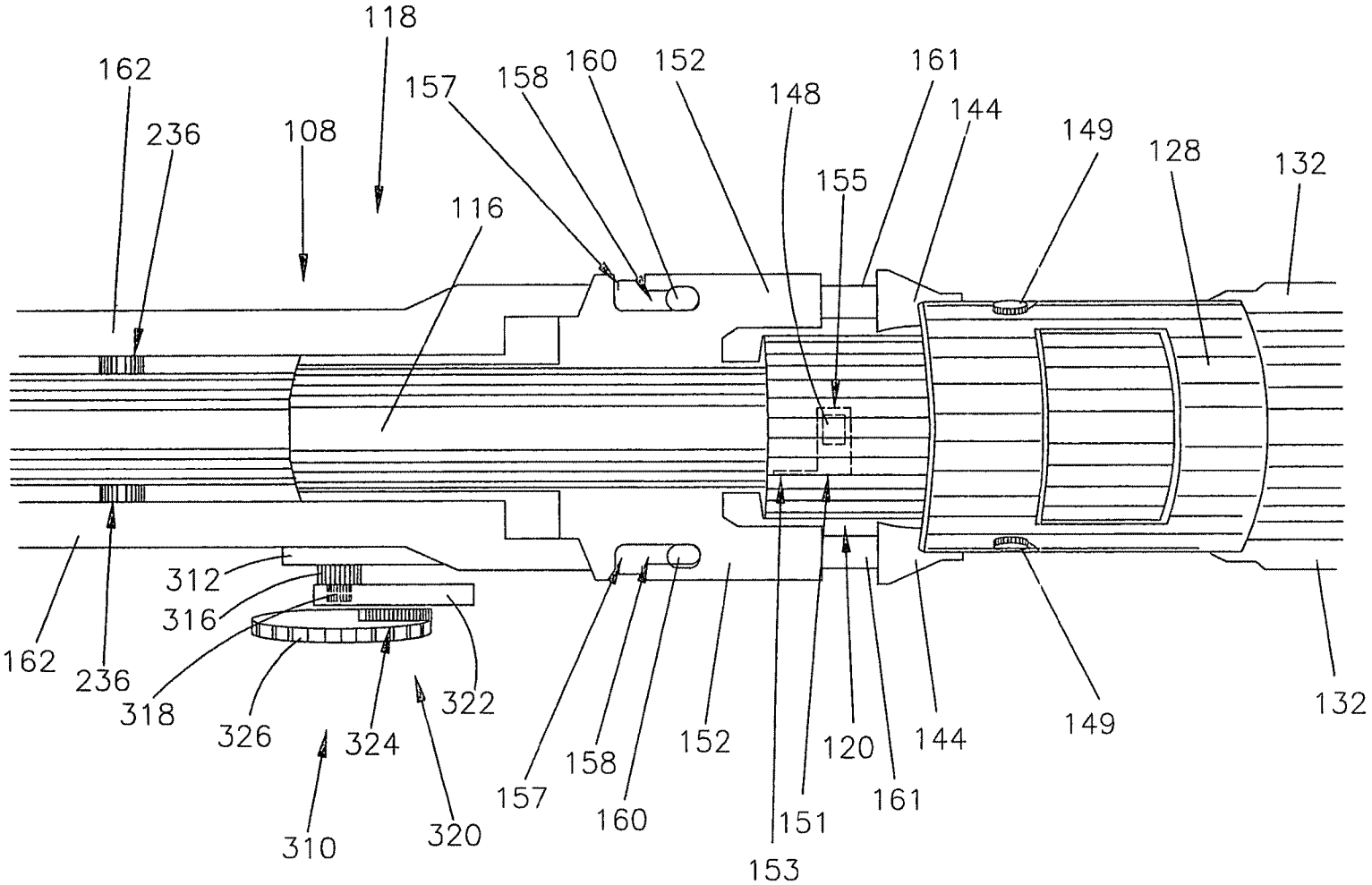
FIG. 8 is a partial top view of the piston driven gas operated machine gun of the present invention with the bolt closed and locked.
Figure 9:
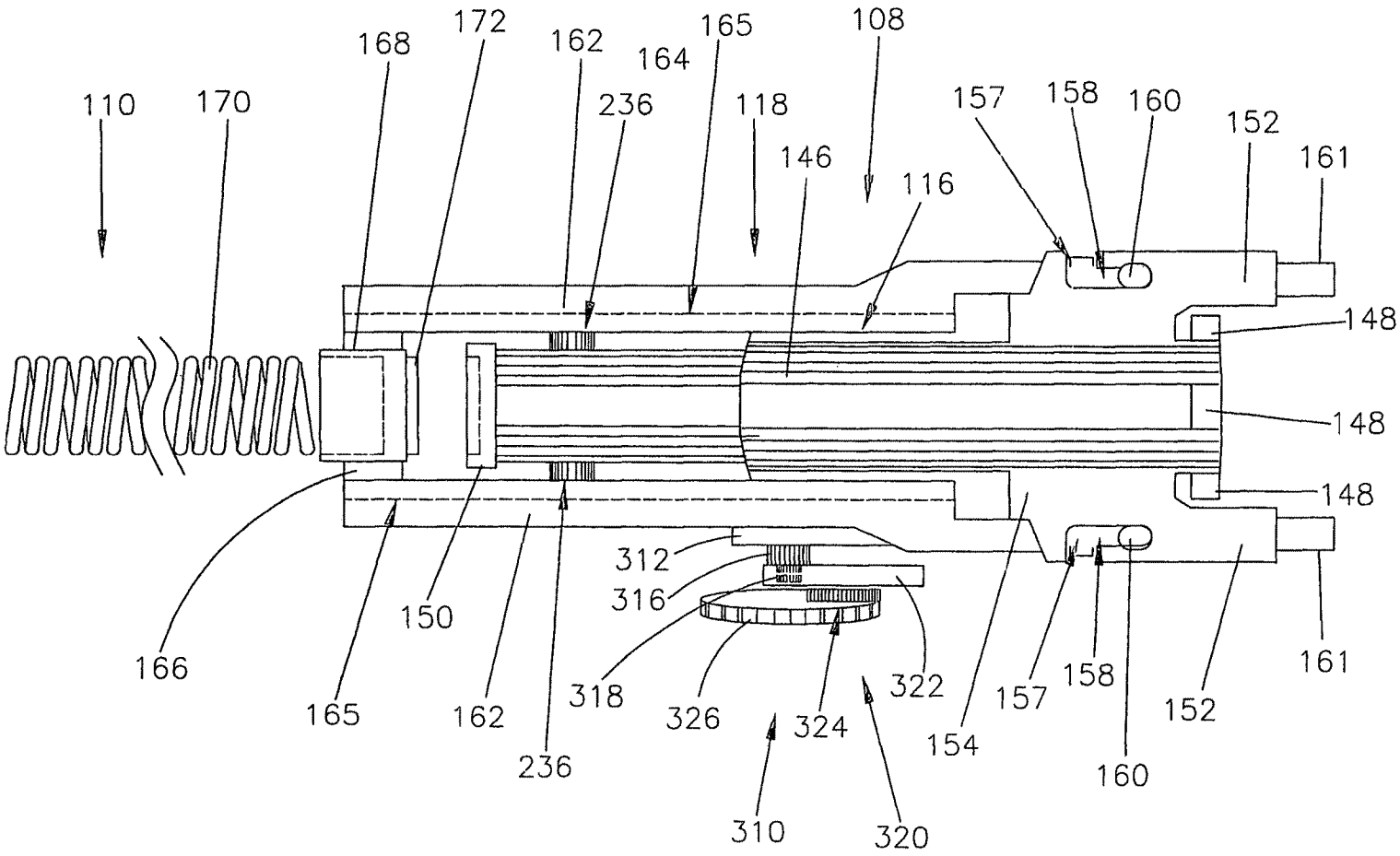
FIG. 9 is a partial top view of the bolt assembly of the present invention with the bolt carriage unlocked from the bolt.
Figure 10:
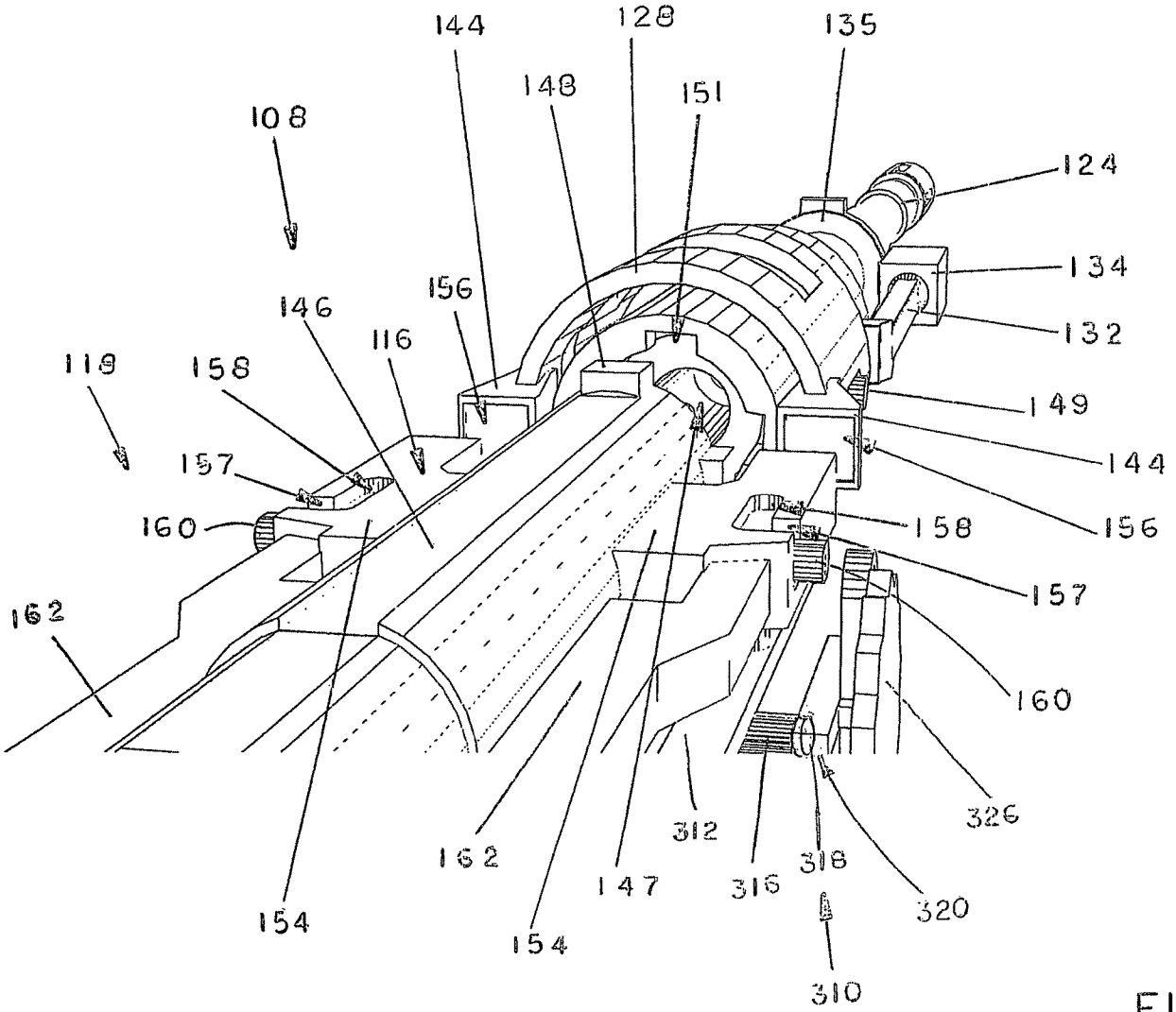
FIG. 10 is a perspective rear view of the bolt assembly with the bolt carriage and bolt locked and the chamber open of the present invention.
Figure 11:
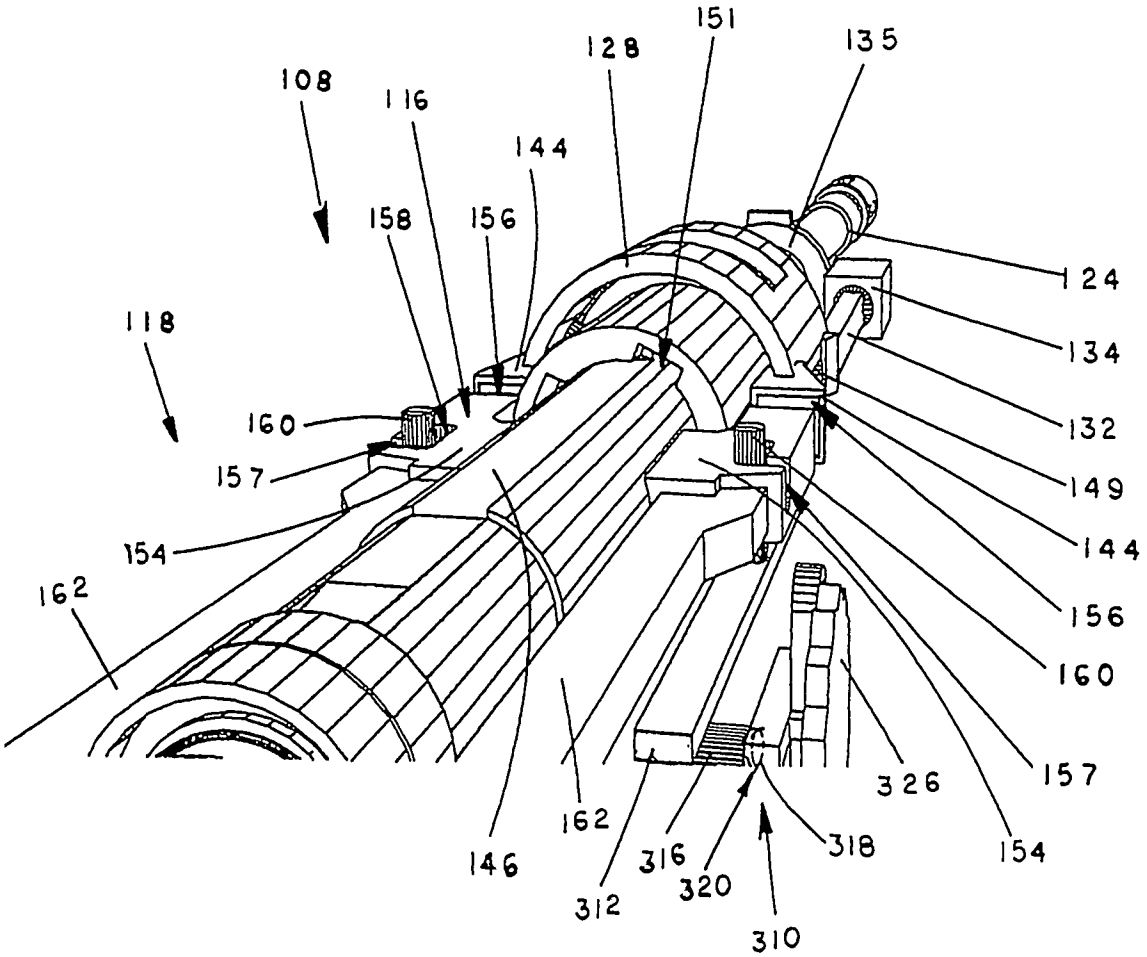
FIG. 11 is a perspective rear view of the bolt and bolt chamber of the present invention in the locked position.
Figure 12:
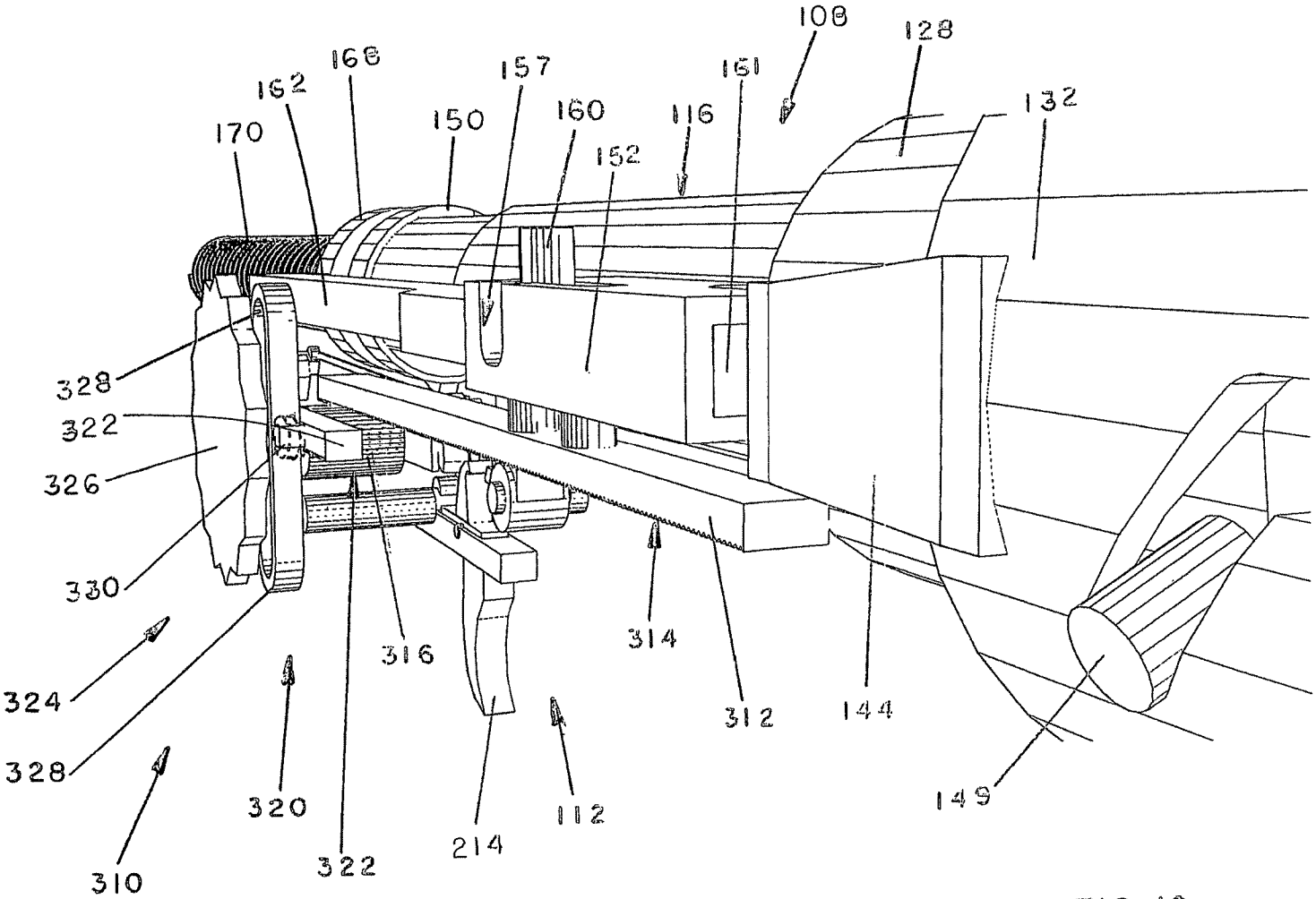
FIG. 12 is a perspective view of the cartridge feed mechanism of the present invention.
Figure 13:
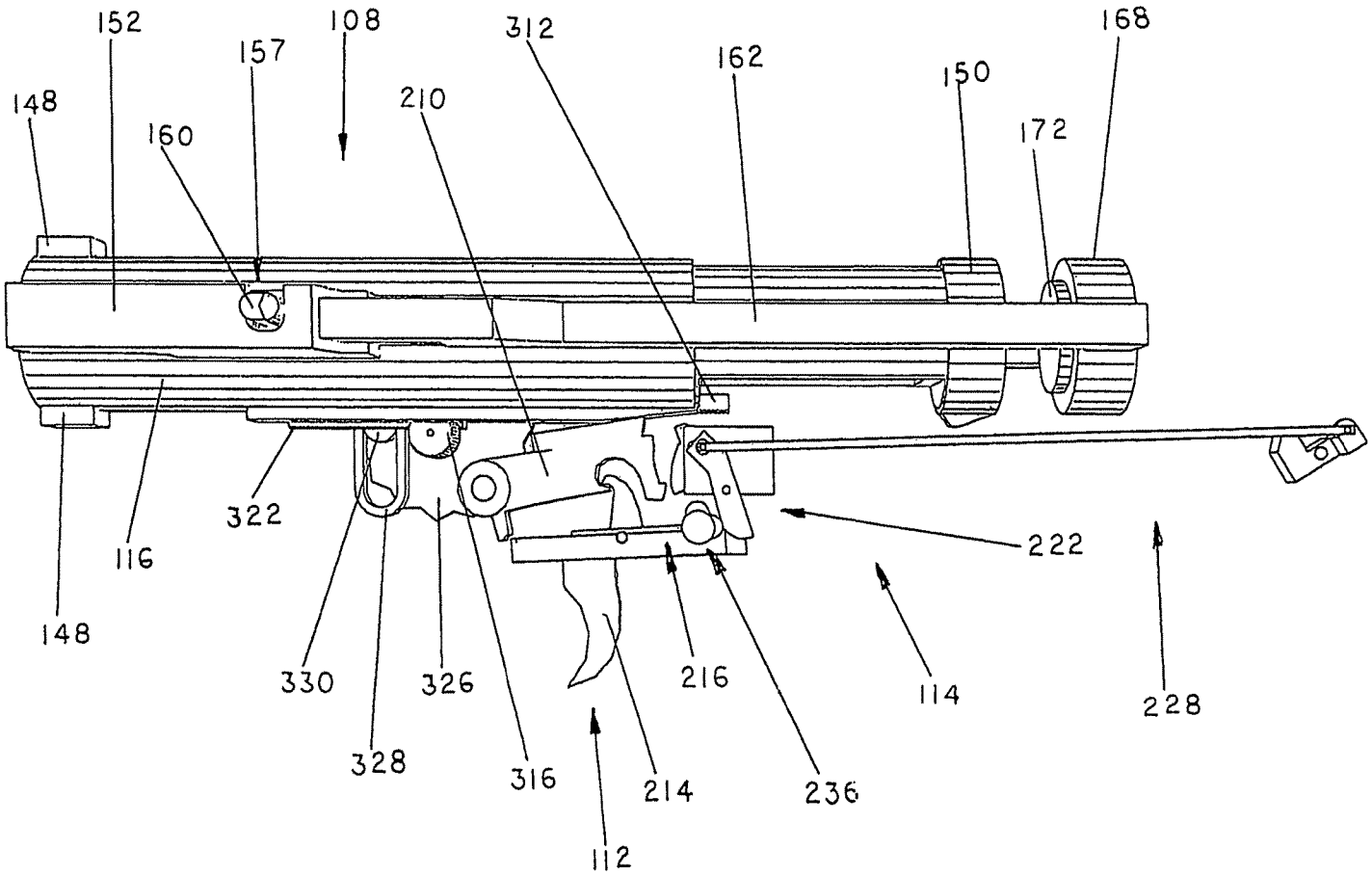
FIG. 13 is a partial side view of the cartridge feed mechanism and sear assembly of the present invention.
Figure 14:
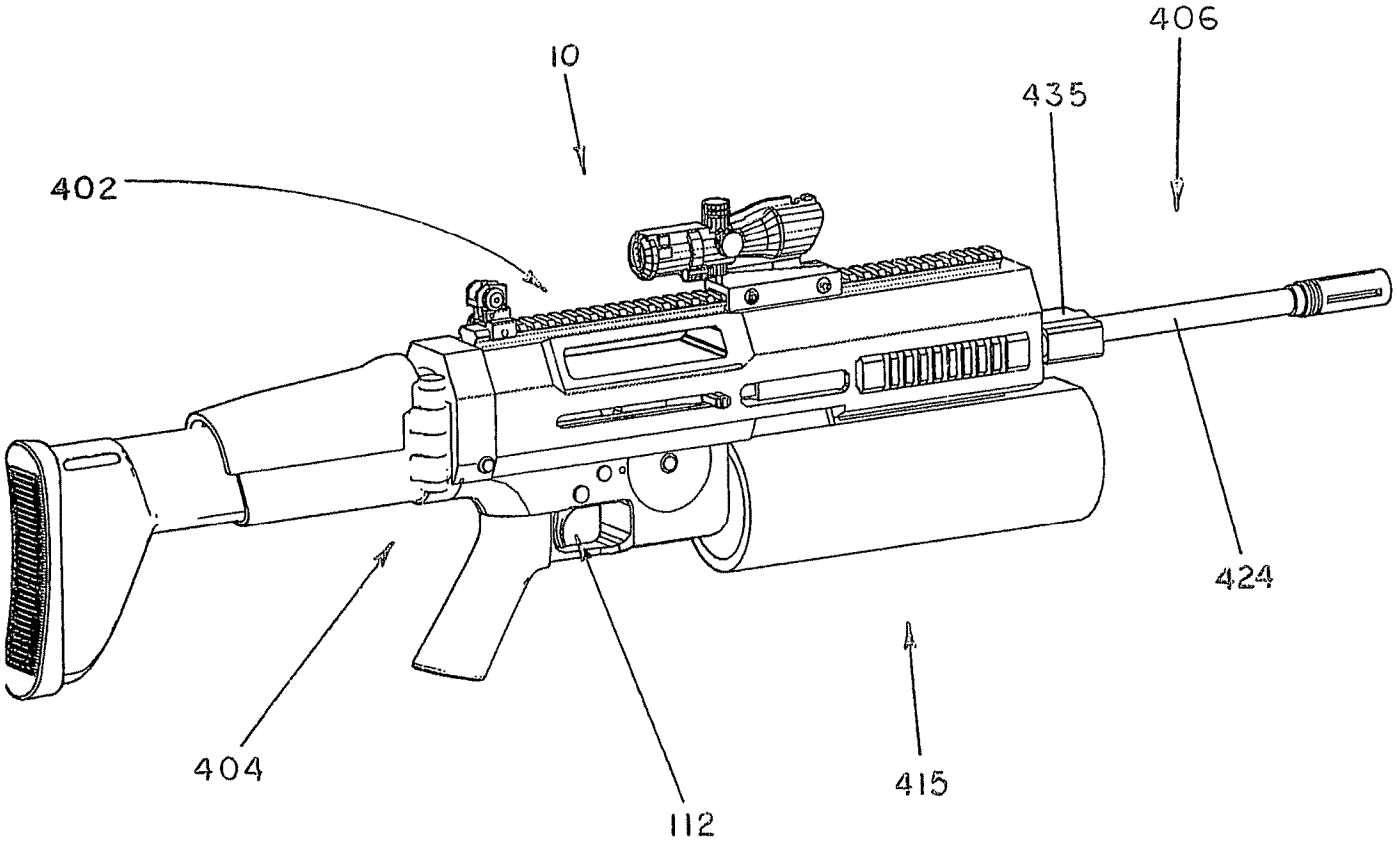
FIG. 14 is a perspective view of an alternate embodiment of the piston driven gas operated machine gun.
Figure 15:
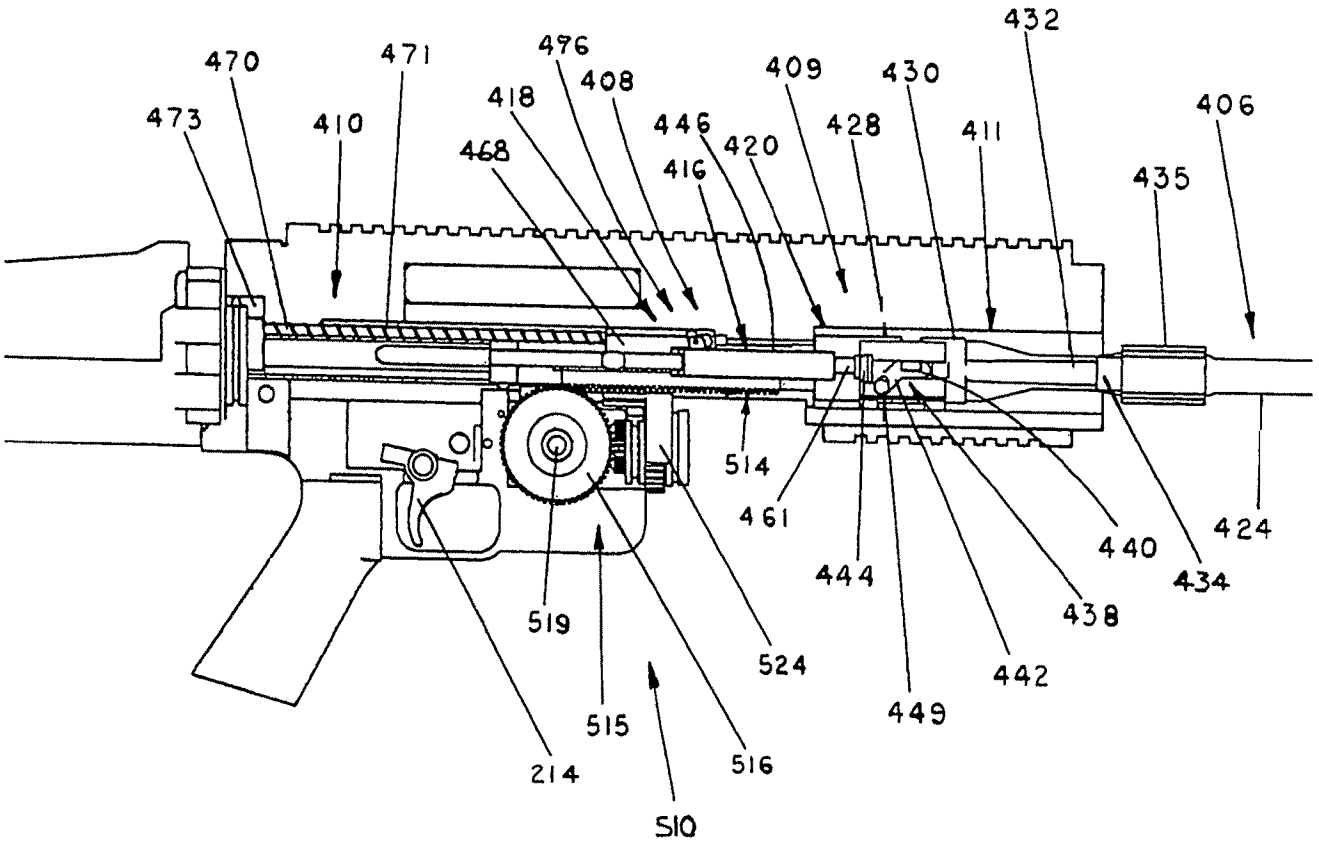
FIGS. 15 through 20 depict the details of the gun feed mechanism of the alternate embodiment of the present invention.
Figure 16:
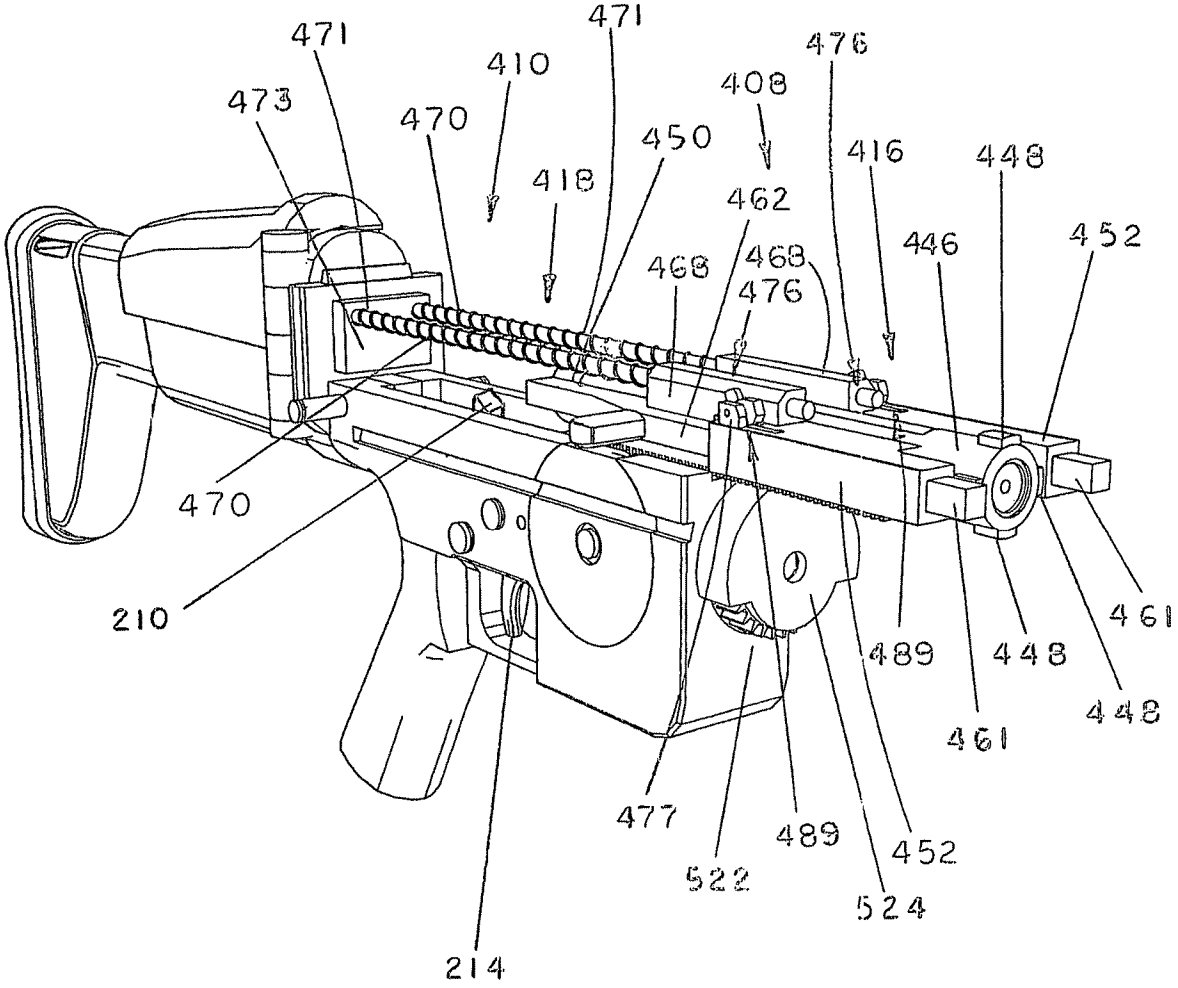
Figure 17:
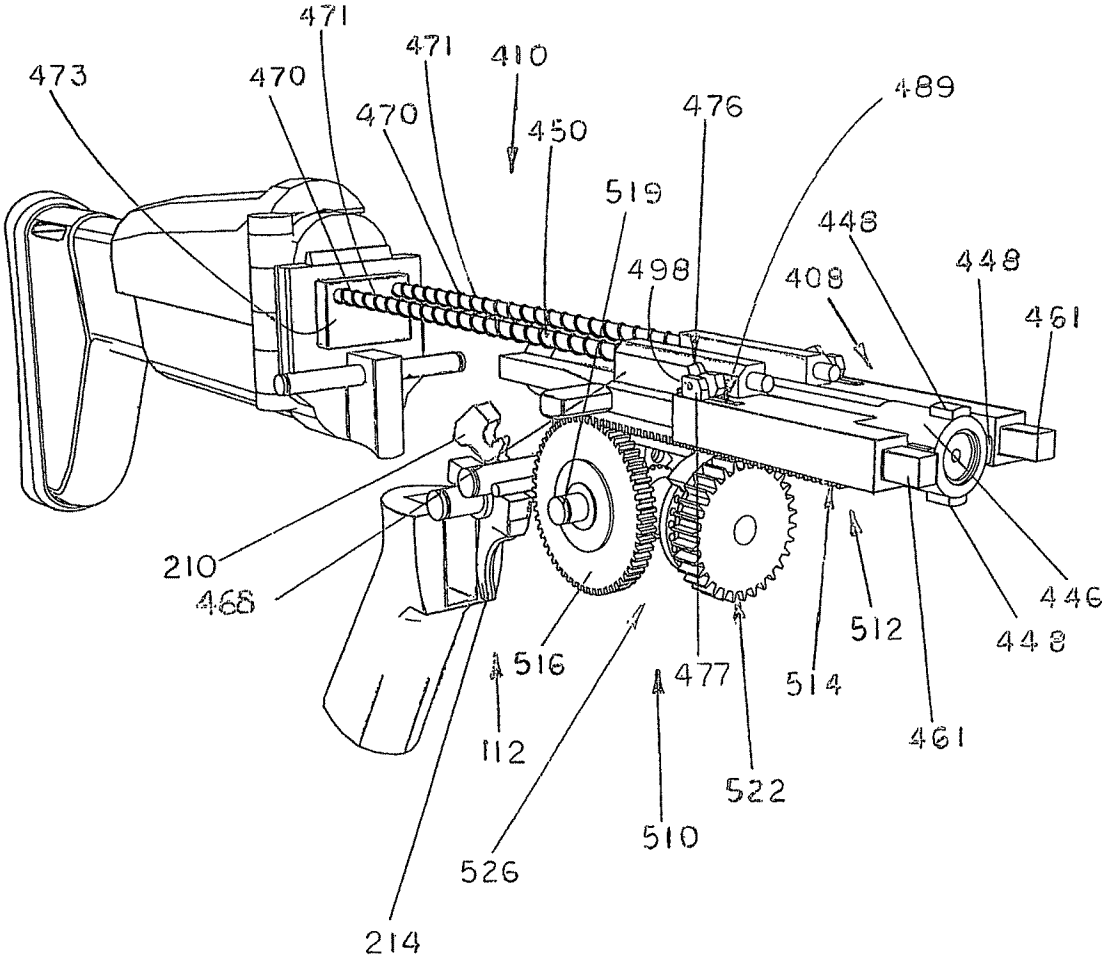
Figure 18:
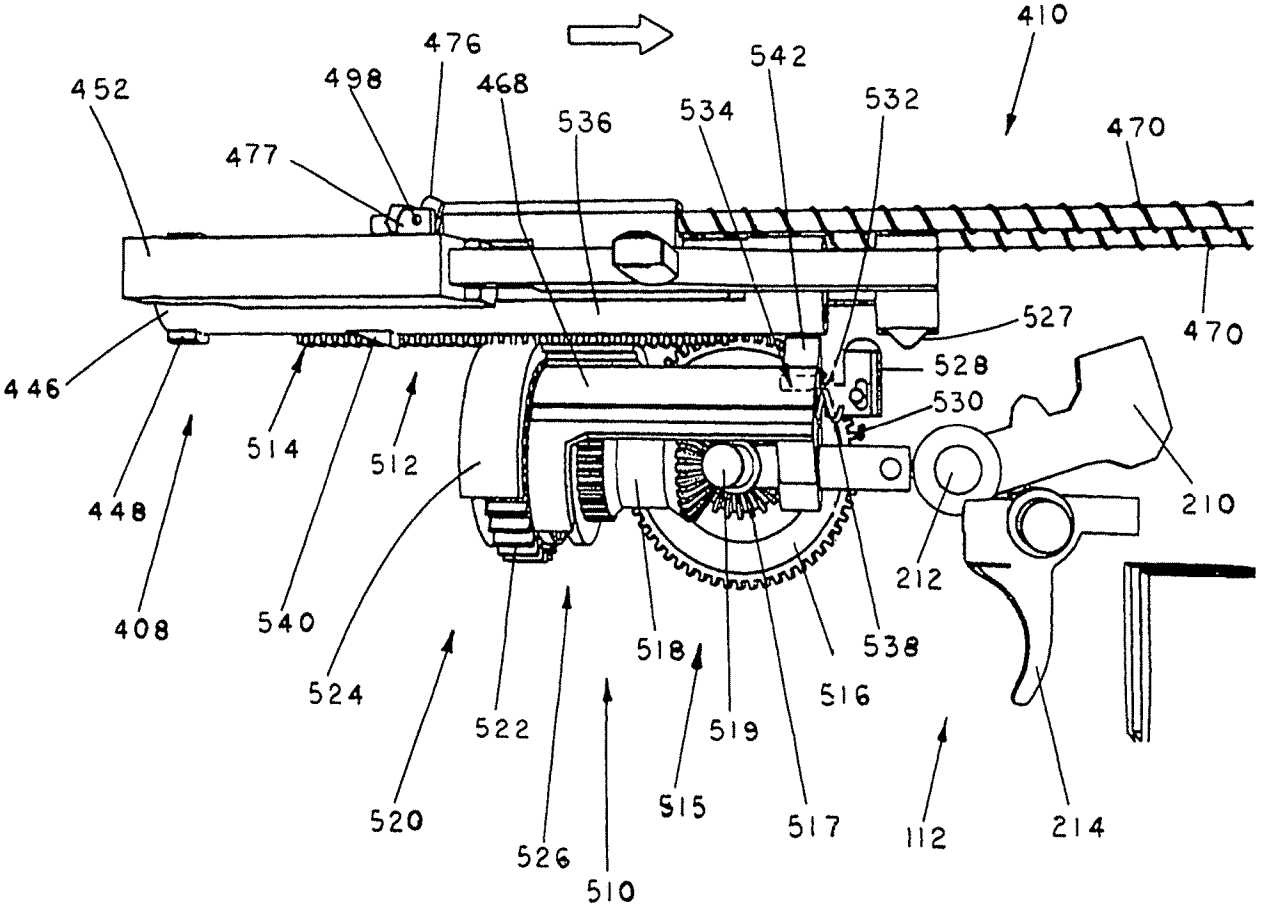
Figure 19:
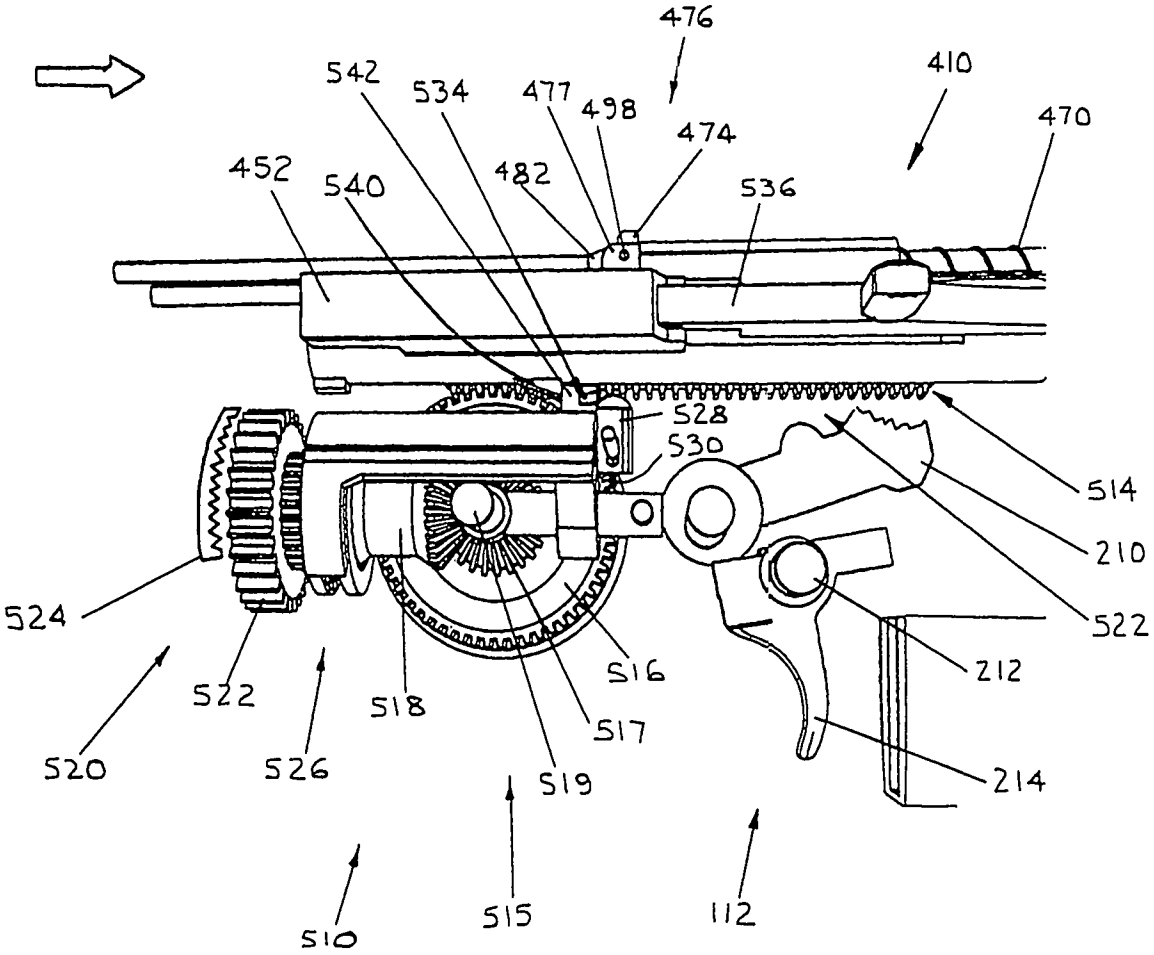
Figure 20:
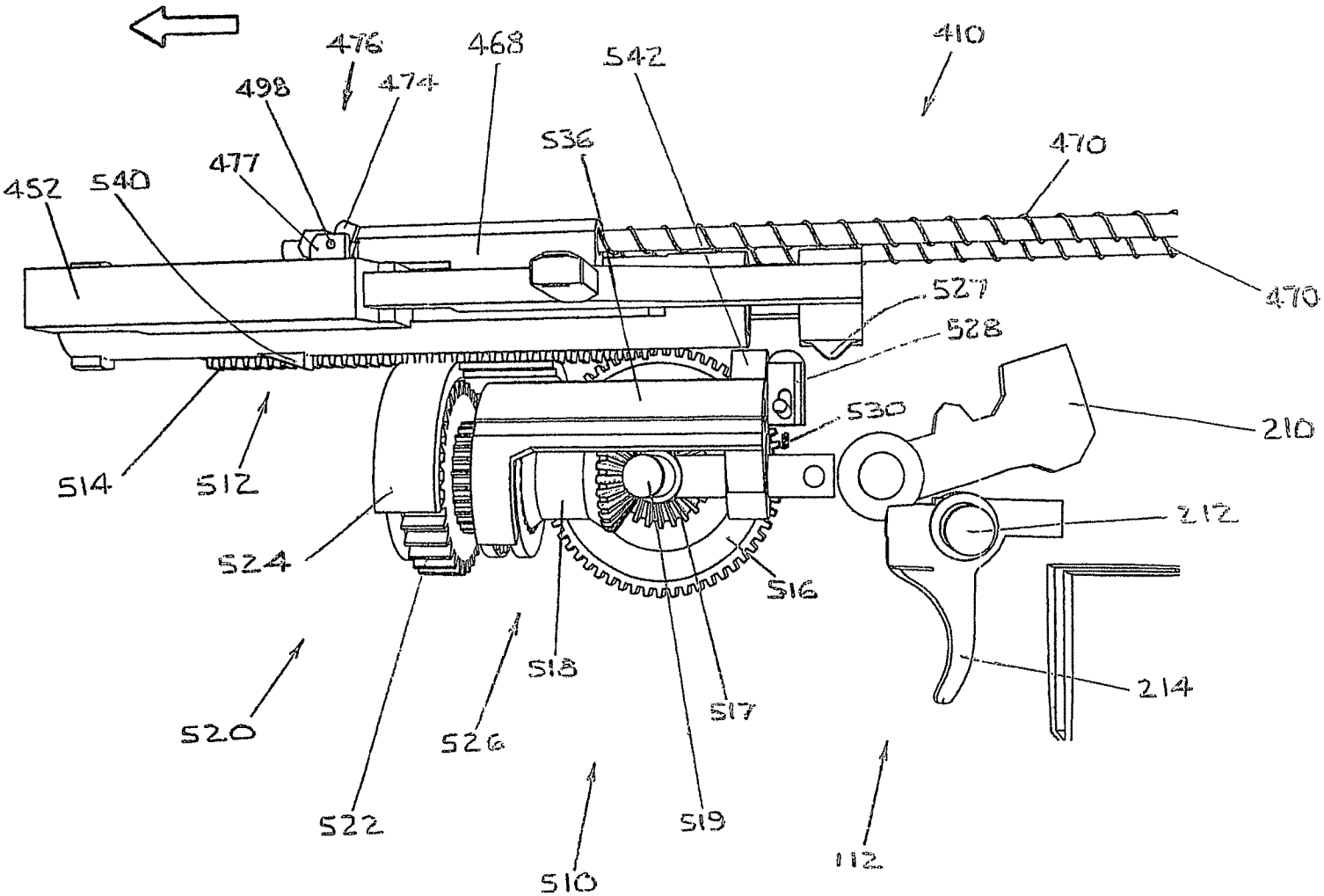

As best shown in FIG. 5, the lower directional control idler mechanism 26 comprises a lower directional control idler drum generally indicated as 52 including a plurality of concave recesses or channels each indicated as 54 to receive the elongated rods or members 34 to change the direction of travel or advancement of the continuous feed belt or flexible element 30 from the vertical direction to the horizontal direction having a lower drum shaft 56 extending outwardly therefrom through a hole 55 (FIG. 2) formed in the center cartridge housing 14 and rotatably supported in a recess 57 formed on the inner surface of the front cover 16.

As shown in FIGS. 2 and 3, the center cartridge housing 14 comprises a rectilinear frame cooperatively formed by a top wall and a bottom wall indicated as 58 and 60 respectively, a pair of side walls each indicated as 62 and a rear wall 64 including a sinusoidal slot 66 extending between the lower portion generally indicated as 68 and the upper portion generally indicated as 70 of the center cartridge housing 14 to receive the plurality of elongated rods or members 34 therethrough while retaining the plurality of enlarged convex or substantially circular guide members 32 behind the rear wall 64 and a gear opening 72 to house at least a portion of the gear assembly 42 disposed in the upper corner portion 74 thereof. A concave cartridge feed ramp 76 is formed adjacent a cartridge feed aperture 78 formed in the top wall 58 to feed cartridges 22 to the bolt driven gas operated machine gun 10. The diameter of each enlarged convex or substantially circular guide member 32 is greater than the width of the sinusoidal slot 66 to retain the enlarged convex or substantially circular guide members 32 between the rear wall 64 of the center cartridge housing 14 and the rear cover 18. An enlarged open sinusoidal channel 80 formed on the interior of the center cartridge housing 14 includes a sinusoidal center line coincident with the sinusoidal center line of the sinusoidal slot 66 formed in the rear wall 64 of the center magazine housing 14 to receive and house the cartridges 22 and the elongated rods or members 34 therein.

As shown in FIG. 2, the front cover 16 comprises a front panel 82 including a front recess 84 and the rear cover 18 comprises a rear panel 86 including a rear recess 88 such that when the ammunition magazine 12 is assembled the front recess 84 and the rear recess 88 are aligned with the gear opening 72 to cooperatively form a gear compartment or housing.

A sinusoidal guide groove 90 dimensioned to receive the enlarged convex or substantially circular guide members 32 therein is formed in the inner surface of the rear panel 86 such that the periphery of each enlarged convex or substantially circular guide member 32 engages the sides of the sinusoidal guide groove 90 to guide the cartridge support assembly 20 and the cartridges 22 through the magazine housing 14 in response to the cartridge feed mechanism driven by the reciprocating bolt action of the gas operated machine gun 10. Specifically, the diameter of each enlarged convex or substantially circular guide member 32 is slightly less than the width of the sinusoidal guide groove 90; while; the thickness of the enlarged convex or substantially circular guide member 32 is slightly less than the depth of the sinusoidal guide groove 90. The center line of the sinusoidal guide groove 90 of the rear panel 86 is coincident with the center line of the sinusoidal slot 66 of the rear wall 64 of the center magazine housing 14.

As mentioned, the diameter of each enlarged convex or substantially circular guide member 32 is greater than the width of the sinusoidal slot 66 to retain the enlarged convex or substantially circular guide members 32 in the sinusoidal guide groove 90 between the rear wall 64 of the center cartridge housing 14 and the rear panel 86 of the rear cover 18. Thus, the enlarged convex or substantially circular guide member 32 is positively guided through the sinusoidal guide groove 90.

The structure and function of the bolt driven gas operated machine gun 10 is best explained and understood with reference to FIGS. 1 and 6 through 13. Specifically, the gas operated machine gun 10 comprises an upper receiver and lower receiver generally indicated as 102 and 104 respectively.

The upper receiver 102 at least partially houses and supports a barrel assembly generally indicated as 106, a bolt assembly generally indicated as 108, a firing chamber positioning mechanism generally indicated as 109 and a bolt positioning assembly including a proximal bolt assembly positioning mechanism generally indicated as 110, and a distal bolt assembly positioning mechanism generally indicated as 111. The lower receiver at least partially houses and supports a firing assembly and a sear assembly generally indicated as 112 and 114 respectively. In addition, a bolt/bolt carriage locking mechanism and a bolt firing chamber locking mechanism selectively lock the bolt and bolt carriage, and the bolt and firing chamber respectively during operation of the bolt driven gas operated machine gun 10 as described hereinafter. As described hereinafter, the various components function in sequence and unison through the loading cycle, firing cycle and ejecting cycle.

The bolt assembly 108 movable between a proximal or rear position and a distal or forward position comprises a bolt and a bolt carrier or carriage generally indicated as 116 and 118 respectively to operate in conjunction with a firing chamber generally indicated as 120.

The barrel assembly 106 comprises a barrel 124 that supports the firing chamber positioning mechanism 109 to control the rotational position of the firing chamber 120 relative to the bolt 116 and the barrel 124 during operation of the bolt driven gas operated machine gun 10 to lock the bolt 116, the bolt carrier or carriage 118 and the firing chamber 120 in position when firing.

The proximal bolt assembly positioning mechanism 110 comprises a compression spring or bias 170 extending between the rear portion of the upper receiver 102 and the bolt carrier or carriage 118.

The distal bolt assembly positioning mechanism 111 comprises a piston rod 132 disposed on each side of the barrel 124 coupled to a corresponding piston housing 134 to house a corresponding gas powered piston or cylinder (not shown) affixed to the barrel 124 to receive gas from the interior of the barrel 124 through a gas ring or block 135 at the firing of each round or cartridge 22. A bias or spring 137 (FIG. 6) is mounted on the barrel mount 130 to bias a hollow substantially cylindrical sleeve 128 rearward toward the bolt 116.

The firing chamber assembly positioning mechanism 109 comprises the hollow substantially cylindrical sleeve 128 slidably and rotatably mounted on the barrel mount 130 affixed to the barrel 124 and operatively coupled to the distal bolt positioning mechanism 111.

The firing chamber assembly positioning mechanism 109 further comprises a chamber positioning pin 149 affixed to each side of the firing chamber 120 and a corresponding cam slot 138 formed on each side of the hollow substantially cylindrical sleeve 128 to cooperatively rotate the firing chamber 120 in a clockwise direction viewed from the rear or proximal end of the bolt driven gas operated mechanism gun 10 as the bolt 116, the bolt carrier or carriage 118 and proximal bolt positioning mechanism 110 move forward toward the firing chamber 120 under the force of the proximal bolt positioning mechanism 110 to lock the bolt 116 and the firing chamber 120 in the firing position or configuration and to rotate the firing chamber 120 in a counter-clockwise direction viewed from the rear or proximal end of the bolt driven gas operated machine gun 10 as the bolt 116, the bolt carrier or carriage 118 and the proximal bolt positioning mechanism 110 move rearward under the force of the gas powered pistons (not shown) and the piston rods 132 of the distal bolt positioning mechanism 111 upon firing a round or cartridge 22 to unlock the bolt 116 from the firing chamber 120.

Each cam slot 138 comprises a substantially longitudinal first leg or portion with a first cam surface 140 and an inclined second leg or portion with a second cam surface 142 disposed in angular relationship to the corresponding first cam surface 140 of the substantially longitudinal first leg or portion. The first cam surface 140 of each cam slot 138 is substantially parallel to the longitudinal axis of the barrel 124 and the barrel assembly 116. The second cam surface 142 is inclined downwardly on one side of the hollow substantially cylindrical sleeve 128; while, the second cam surface 142 on the opposite side of the hollow substantially cylindrical sleeve 128 is inclined upwardly.

A stop element or member 144 is affixed to each side of the hollow substantially cylindrical sleeve 128 to sequentially engage the distal end portion of the bolt 116 and a portion of the bolt carrier or carriage 118 to move the hollow substantially cylindrical sleeve 128 forward by engaging the bolt carrier or carriage 118 causing the firing chamber 120 to rotate as the chamber positioning pins 149 slide or move from the distal origin of the cam slots 138 along the longitudinal portion of the first cam surfaces 140 to the second cam surfaces 142 of the angled portions of the cam slots 138 to lock the bolt 116 and the firing chamber 120 including a bore 147 together prior to firing. Upon firing the bolt carrier or carriage 118 is pushed or moved rearwardly by the gas powered pistons (not shown) and piston rods 132 rotating the firing chamber 120 by the cooperative engagement of each cam slot 138 and a corresponding chamber positioning pin 149 unlocking the bolt 116 from the firing chamber 120. The bolt 116 and bolt carriage 118 together then move rearwardly to the proximal end of the bolt driven gas powered machine gun 10 as a unit.

As previously stated, the bolt assembly 108 includes the bolt 116, the bolt carrier or carriage 118 operating in combination with the firing chamber 120. The bolt 116 comprises a substantially cylindrical bolt body 146 having a plurality of locking keys or lugs each indicated as 148 formed on the inner or distal end portion thereof to selectively engage a corresponding plurality of locking grooves or keyways each generally indicated as 151 formed in the interior surface of the firing chamber 120 to cooperatively form a bolt/firing chamber locking mechanism to lock the substantially cylindrical bolt body 146 of the bolt 116 and the firing chamber 120 together during firing of the bolt driven gas operated machine gun 10. An enlarged outer or proximal end portion 150 is formed on the proximal end portion of the bolt carriage 118 to selectively engage a portion of the proximal bolt positioning mechanism 110, the bolt 116 and the sear assembly 114.

The plurality of locking grooves or keyways each generally indicated as 151 are formed about the outer lip or edge of the bore 147 of the firing chamber 120 to receive the keys or lugs 148 and rotate the firing chamber 120 to lock and unlock the bolt 116 and firing chamber 120 as the bolt driven gas operated machine gun 10 is operated. Each locking groove or keyway 151 comprises a longitudinally disposed leg or channel 153 extending inwardly from the proximal end of the firing chamber 120 and a laterally disposed leg or channel 155 extending substantially at a right angle from the inner end of the longitudinally disposed leg or channel 153 to receive the corresponding locking key or lug 140 and lock the bolt 116 and firing chamber 120 together.

A yoke including a hollow arm or member 152 held in fixed spaced relationship on each side of the substantially cylindrical bolt body 146 of the bolt 116 by a base 154 is disposed in axial alignment relative to the corresponding longitudinal stop element or member 144 that may include a recess 156 formed on the rear portion of each side of hollow substantially cylindrical sleeve 128 of the bolt locking mechanism 109.

As previously described, the chamber positioning pin 149 extending outwardly from each side of the firing chamber 120 is disposed to engage the first cam surface 140 and the second cam surface 142 of each cam slot 138 during the loading, firing and ejecting cycles to rotate the firing chamber 120 relative to the bolt 116 and hollow substantially cylindrical sleeve 128.

The bolt carrier or carriage 118 comprises a distal lateral member 161 at least partially disposed within the corresponding hollow arm or member 152 of the yoke of the bolt 116 coupled together by a proximal lateral member 162. As described hereinafter, the distal lateral members 161 are slidably disposed between a retracted and extended position within the corresponding hollow arm or member 152.

The bolt assembly 108 includes the bolt/bolt carriage locking mechanism movable between a first or locked and second or unlocked position to selectively lock the bolt 116 and bolt carrier or carriage 118 to lock the distal lateral member 161 in the retracted position relative to the corresponding hollow arm or member 152 when in the first or locked position and unlock the bolt 116 from the bolt carriage 118 allowing the distal lateral member 161 to extend or retract relative to the corresponding hollow arm or member 152 during the locking and unlocking of the bolt 116 and the firing chamber 120 as the bolt assembly 108 travels fore and aft under the force of the proximal bolt assembly position mechanism 110 and the distal bolt assembly positioning mechanism 111 during operation of the bolt driven gas operated machine gun 10.

Specifically, a substantially vertical side slot 157 and a substantially horizontal or longitudinal upper slot 158 are formed on each side of the yoke forming a proximal stop or limit and a distal stop or limit respectively to selectively receive a corresponding bolt carrier or carriage post or limit element 160 positioned by ramp or cam 163 to control the longitudinal movement of the bolt 116 relative to the bolt carrier or carriage 118 during operation of the gas operated gun 10.

When loading or chambering a round or cartridge 22, the distal bolt positioning mechanism 111 is in the forward most position with each chamber positioning pin 149 engaging the forward most portion of the corresponding cam slot 138. Each bolt carrier or carriage post or limit element 160 is disposed within the corresponding substantially vertical side slot 157 locking the bolt 116 and bolt carrier or carriage 118 together with the forward portion of each lateral member 161 of the proximal bolt position mechanism 110 retracted within the corresponding hollow arm or member 152 and the proximal end portion 150 of the bolt 118 and the proximal end portion 168 of the bolt carriage 118 are locked in spaced relationship relative to each other.

Initially, upon pulling the trigger, the proximal bolt positioning mechanism 110, bolt 116 and bolt carrier or carriage 118 are moved forward by the force of the bias or spring 170 of the proximal bolt assembly positioning mechanism 110.

A round or cartridge 22 from the ammunition magazine 12 is advanced by the bias or spring 170 of the proximal bolt assembly positioning mechanism 110 by engaging the enlarged proximal or outer portion 168 of the bolt carrier or carriage 118 in spaced relationship relative to the enlarged outer end portion 150 of the bolt 116 toward and into the bore 147 of the firing chamber 120 by the bolt 116. As the forward portion of each hollow arm or member 152 engages the corresponding stop or recess 156, the hollow substantially cylindrical sleeve 128, piston rods 132 and gas powered pistons or cylinders (not shown) are pushed forward moving the intersection of the substantially horizontal first leg and the corresponding inclined second leg of the cam slots 138 of the firing chamber locking mechanism 109 toward the chamber positioning pins 149 as each bolt carrier or carriage post or element 160 is rotated to the corresponding vertical position by the ramp or cam 163 unlocking the bolt carrier or carriage 118 and distal bolt assembly positioning mechanism 111 from the locked position relative to each other allowing the reduced inner portion 172 to engage the outer end portion 150 under the force of the bias 170. As the bolt carrier or carriage 118 and proximal bolt positioning mechanism 110 continues to move forward together the distal end of the lateral members 161 of the proximal bolt positioning mechanism 110 extend outwardly from the hollow arms or members 152 moving the hollow substantially cylindrical sleeve 128, piston rods 132 and gas powered pistons (not shown) toward the distal end of the bolt driven gas operated machine gun 10 as the chamber positioning pins 149 move along the inclined second cam surfaces 142 of the corresponding cam shaft rotating the firing chamber 120 relative to the bolt 116 causing the keys or lugs 148 to initially enter the corresponding longitudinally disposed leg or channel 153 of the locking groove or keyway 151 and then enter into the corresponding laterally disposed leg or channel 155 of the locking groove or keyway 151 as the firing chamber 120 is rotated. Once the bolt 116 and firing chamber 120 are locked together, the bolt driven gas operated machine gun 10 fires.

As previously described, once fired, the gas from the spent round pushes the gas powered pistons (not shown), piston rods 132 and hollow substantially cylindrical sleeve 128 in the opposite or rearward direction to eject the spent round or cartridge 22 and unlock the bolt 116 from the firing chamber 120 while repositioning the components toward the proximal end of the bolt operated gas operated machine gun 10 to continue firing additional rounds or cartridges 22.

In summary, the bolt assembly 108 comprises the bolt 116 and bolt carriage 118 movable each between a proximal or rearward position and a distal or forward position by a bolt positioning assembly including a proximal bolt positioning assembly 110 to move the bolt assembly forward and a distal bolt positioning assembly 111 to move the bolt assembly rearward.

The bolt/bolt carriage locking mechanism is movable between a first or locked position and a second or unlocked position such that the bolt 116 and bolt carriage 118 move together when in the first or locked position and the bolt carriage 118 is movable relative to the bolt 116 when in the second or unlocked position whereby the firing chamber positioning mechanism is moved (rotated) from a first position to a second position moving the bolt firing chamber locking mechanism 109 from an unlocked position to a locked position by the proximal bolt positioning mechanism 110 to lock the bolt 116 and the firing chamber 120 together for firing and the distal bolt positioning mechanism 111 moves (rotates) the firing chamber positioning mechanism from the second position to the first position moving the bolt/firing chamber 109 locking mechanism to the unlocked position to unlock the bolt 116 from the firing chamber 120 moving the bolt carriage 118 rearward moving the bolt/bolt carriage locking assembly from the unlocked to locked position locking the bolt 116 and bolt carriage 118 together to move the bolt assembly 108 rearward disengaging the bolt 116 from the firing chamber 120 returning the bolt assembly 108 to open bolt from the firing chamber 120 when operating in open bolt configuration.

As shown in FIGS. 1, 2, and 10 through 13, the gun feed mechanism generally indicated as 310 comprises a bolt driven assembly disposed in operative relationship to the magazine drive gear 44 of the upper magazine drive mechanism 24 of the magazine feed mechanism and the lower receiver 104 of the gas operated machine gun 10 to drive the magazine feed mechanism to feed cartridges 22 through the cartridge feed opening 78 to the gas operated machine gun 10.

The gun feed mechanism 310 comprises a first or linear drive assembly such as a rack 312 including a plurality of teeth generally indicated as 314 affixed to the bolt 116 of the bolt assembly 108, a second or rotational drive assembly including a first intermediate member 316 such as a large cylinder with teeth formed on the outer surface thereof and a second intermediate member 318 such as a small cylinder with teeth formed in the outer surface thereof affixed or coupled to each other and a third or linear drive assembly generally indicated as 320 including a linear drive member or rack generally indicated as 322 having a plurality of teeth and a gear/loop combination generally indicated as 324. The gear/loop combination 324 comprises a substantially circular gear 326 operatively coupled to a substantially vertically disposed oval loop 328 by a directional control post 330 affixed to the substantially circular gear 326. The substantially circular gear 326 is disposed to engage the magazine drive gear 44 of the magazine feed assembly 24 to cooperatively translate the linear motion of the bolt 116 during the operating cycles of the gas operated machine gun 10 to rotational motion to move the continuous feed belt or flexible element 30 through the ammunition magazine 12 to continuously feed cartridges 22 to the bolt assembly 108 through the cartridge feed aperture 68 formed in the top wall 48 of the center cartridge housing 14 of the ammunition magazine 12.

In operation as the bolt 116 moves fore and aft, the linear movement of the first or linear drive assembly or rack 312 rotates the second or intermediate drive assembly 316 that translates into linear movement of the linear drive member or rack 322 to rotate the generally circular gear 326 as the oval loop 328 translates the linear movement of the linear drive member or rack 322 to a rotational path by the directional control post 330 to drive the magazine drive gear 44 of the magazine feed mechanism to feed the cartridges 22 to the bolt driven gas operated machine gun 10.

FIGS. 14 through 23 show an alternate embodiment of the bolt driven gas operated machine gun 10. Specifically, the bolt driven gas operated machine gun 10 comprises an upper receiver and lower receiver generally indicated as 402 and 404 respectively. Unless otherwise noted, the various components are substantially the same as those components of the embodiment previously described.

The upper receiver 402 at least partially houses and supports a barrel assembly generally indicated as 406, a bolt assembly generally indicated as 408 and a firing chamber positioning mechanism 409 and a bolt positioning assembly including a proximal bolt positioning mechanism generally indicated as 410, and a distal bolt positioning mechanism generally indicated as 411 substantially the same as that described in the earlier embodiment. The lower receiver 404 at least partially houses and supports a firing assembly and a sear assembly generally indicated as 112 and 114 respectively. In addition, an ammunition magazine generally indicated as 415 is detachably mounted to the lower receiver 404. As previously described, the various components function in unison through the loading cycle, firing cycle and ejecting cycle.

The bolt assembly 408 comprises a bolt and a bolt carrier or carriage generally indicated as 416 and 418 respectively to operate in conjunction with a firing chamber generally indicated as 420.

The barrel assembly 406 comprises a barrel 424 that supports the firing chamber position mechanism 409 to control the rotational position of the firing chamber 420 relative to the bolt 416 and the barrel 424 during operation of the gas operated machine gun 410 to lock the bolt 416 and the firing chamber 420 in position during firing as previously described with respect to the first embodiment.

The proximal bolt assembly positioning mechanism 410 comprises a pair of compression springs each indicated as 470 each mounted on a corresponding support member or rod 471 extending between an upper block or member 468 of the bolt carrier or carriage 418 and a back plate 473.

The distal bolt positioning mechanism comprises a piston rod 432 disposed on each side of the barrel 424 coupled to a corresponding piston housing 434 to house a corresponding gas powered piston or cylinder (not shown affixed to the barrel 424 to receive gas from the interior of the barrel 424 through a gas ring or block 435 at the firing of each round or cartridge 22. As with the earlier described embodiment, a bias or spring is mounted on the barrel mount to bias a hollow substantially cylindrical sleeve 428 rearward toward the bolt 416.

As with the earlier described embodiment, the firing chamber positioning mechanism 409 comprises the hollow substantially cylindrical sleeve 428 slidably and rotatably mounted on a barrel mount 430 affixed to the barrel 424 and operatively coupled to the distal bolt assembly positioning mechanism 411.

The firing chamber positioning mechanism 409 further comprises a chamber positioning pin 449 affixed to each side of the firing chamber 420 and a corresponding cam slot 438 formed on each side of the hollow substantially cylindrical sleeve 428 to cooperatively rotate the firing chamber 420 in a clockwise direction viewed from the rear or proximal end of the bolt driven gas operated mechanism gun 10 as the bolt 416, the bolt carrier or carriage 418 and proximal bolt positioning mechanism 410 move forward toward the firing chamber 420 under the force of the proximal bolt positioning mechanism 410 to lock the bolt 416 and the firing chamber 420 in the firing position or configuration and to rotate the firing chamber 420 in a counter-clockwise direction viewed from the rear or proximal end of the bolt driven gas operated machine gun 10 as the bolt 416, the bolt carrier or carriage 418 and the proximal bolt positioning mechanism 410 move rearward under the force of the gas powered pistons (not shown) and the piston rods of the distal bolt positioning mechanism 411 upon firing a round or cartridge 22 to unlock the bolt 416 from the firing chamber 420.

As previously described, each cam slot 438 comprises a substantially longitudinal first leg or portion with a first cam surface 440 and an inclined second leg or portion with a second cam surface 442 disposed in angular relationship to the corresponding first cam surface 440 of the substantially longitudinal first leg or portion. The first cam surface 440 of each cam slot 438 is substantially parallel to the longitudinal axis of the barrel 424 and the barrel assembly 416. The second cam surface 424 is inclined downwardly on one side of the hollow substantially cylindrical sleeve 428; while, the second cam surface 442 on the opposite side of the hollow substantially cylindrical sleeve 428 is inclined upwardly.

A stop element or member 444 is affixed to each side of the hollow substantially cylindrical sleeve 428 to sequentially engage the distal end portion of the bolt 416 and a portion of the bolt carrier or carriage 418 to move the hollow substantially cylindrical sleeve 428 forward by first engaging the bolt 416 and then engaging the bolt carrier or carriage 418 causing the firing chamber 420 to rotate as the chamber positioning pins 449 slide or move from the distal origin of the cam slots 438 along the longitudinal portion of the first cam surfaces 440 to the second cam surfaces 442 of the angled portions of the cam slots 448 to lock the bolt 416 and the firing chamber 420 together prior to firing. Upon firing the bolt carrier or carriage 418 is pushed or moved rearwardly by the gas powered pistons (not shown) and piston rods 432 rotating the firing chamber 420 by the cooperative engagement of each cam slot 438 and a corresponding chamber positioning pin 449 unlocking the bolt 416 from the firing chamber 420. Initially, the bolt carriage 418 moves rearwardly until he bolt 416 are locked together. Then the bolt 416 and bolt carriage 418 then move rearwardly together to the proximal end of the bolt driven gas powered machine gun 10 as a unit.

As previously stated, the bolt assembly 408 includes the bolt 416, the bolt carrier or carriage 418 operating in combination with the firing chamber 420. The bolt 416 comprises a substantially cylindrical bolt body 446 having a plurality of locking keys or lugs each indicated as 448 formed on the inner end portion thereof to selectively engage a corresponding plurality of locking grooves or keyways each generally indicated as 451 formed in the interior surface of the firing chamber 420 to cooperatively form a bolt/firing chamber locking mechanism to lock the substantially cylindrical bolt body 446 of the bolt 416 and the firing chamber 420 together during the bolt drive firing of the gas operated machine gun 10. An enlarged outer or proximal end portion 450 is formed on the proximal end portion of the bolt carriage 418 to selectively engage a portion of the proximal bolt positioning mechanism 410, bolt 416, and the sear assembly 114.

The plurality of locking grooves or keyways are formed about the outer lip or edge of the bore 447 of the firing chamber 420 to receive the locking keys or lugs 448 and rotate the firing chamber 420 to lock and unlock the bolt 416 and the firing chamber 420 as the bolt driven gas operated machine gun 10 is operated. Each locking groove or keyway 451 comprises a substantially longitudinally disposed leg or channel 453 extending from the proximal end of the firing chamber 420 and a substantially laterally disposed leg or channel 455 extending substantially perpendicular from the inner end of the longitudinally disposed leg or channel to receive the corresponding locking key or lug 440 and lock the bolt 416 and firing chamber (not shown) together as described in the first embodiment.

A yoke including a hollow arm or member 452 disposed in fixed spaced relationship on each side of the substantially cylindrical bolt body 446 by a base 454 in axial alignment relative to the corresponding longitudinal stop element or member 444 that may include a recess 456 formed on the proximal rear portion of each side of hollow substantially cylindrical sleeve of the bolt locking mechanism 409.

As previously described with respect to the first embodiment, the chamber positioning pin 449 extending outwardly from each side of the firing chamber is disposed to engage the first cam surface 440 and the second cam surface 442 of each cam slot 438 during the loading, firing and ejecting cycles to rotate the firing chamber 420 relative to the bolt 416 and hollow substantially cylindrical sleeve 428.

The bolt carrier or carriage 418 comprises a distal lateral member 461 at least partially disposed within the corresponding hollow arm or member 452 of the yoke of the bolt 416 coupled together by a proximal lateral member 462. As described hereinafter, the distal lateral members 461 are slidably disposed between a retracted and extended position within the corresponding hollow arm or member 452.

The alternate embodiment of the bolt driven gas operated machine gun 10 includes an alternate embodiment of the bolt/bolt carriage locking or coupling mechanism to selectively lock the bolt 416 and bolt carrier or carriage 418 as the bolt 416 and bolt carrier or carriage 418 move fore and aft during operation of the bolt driven gas operated gun 10.

Specifically, FIGS. 18 through 23 disclose a pair of bolt/bolt carriage locking or coupling mechanisms movable between a locked position or configuration and an unlocked position or configuration to move the bolt 416 and bolt carrier or carriage 418 together as the bolt 416 and bolt carrier or carriage 418 move fore and aft when in the locked position while the distal lateral members 461 of the bolt carrier or carriage 418 extend and retract within the hollow arms or members 452 of the bolt 416 when the pair of bolt/bolt carriage locking or coupling mechanisms are in the unlocked position.

Figure 21:
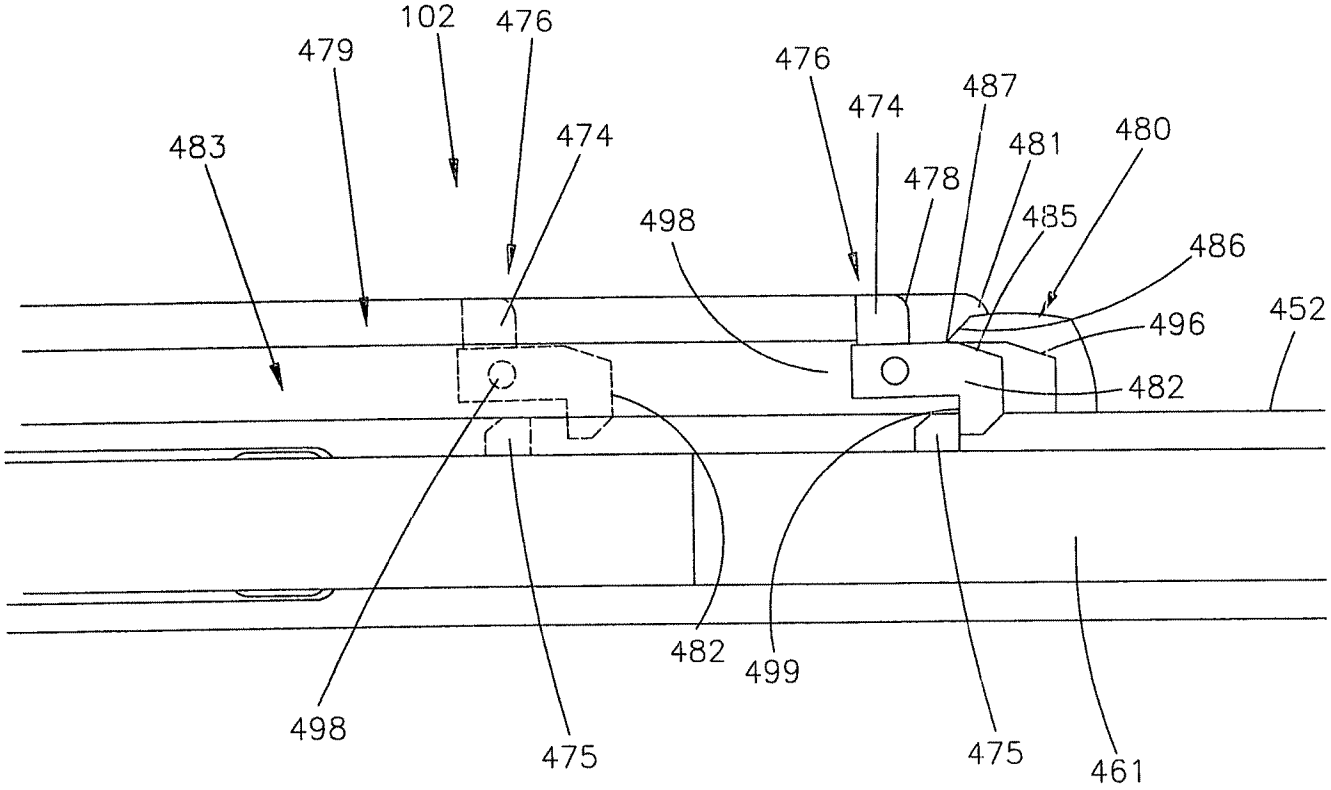
FIGS. 21 through 23 depict the bolt/bolt carrier or carriage locking mechanism of the alternate embodiment of the present invention.
Figure 22:
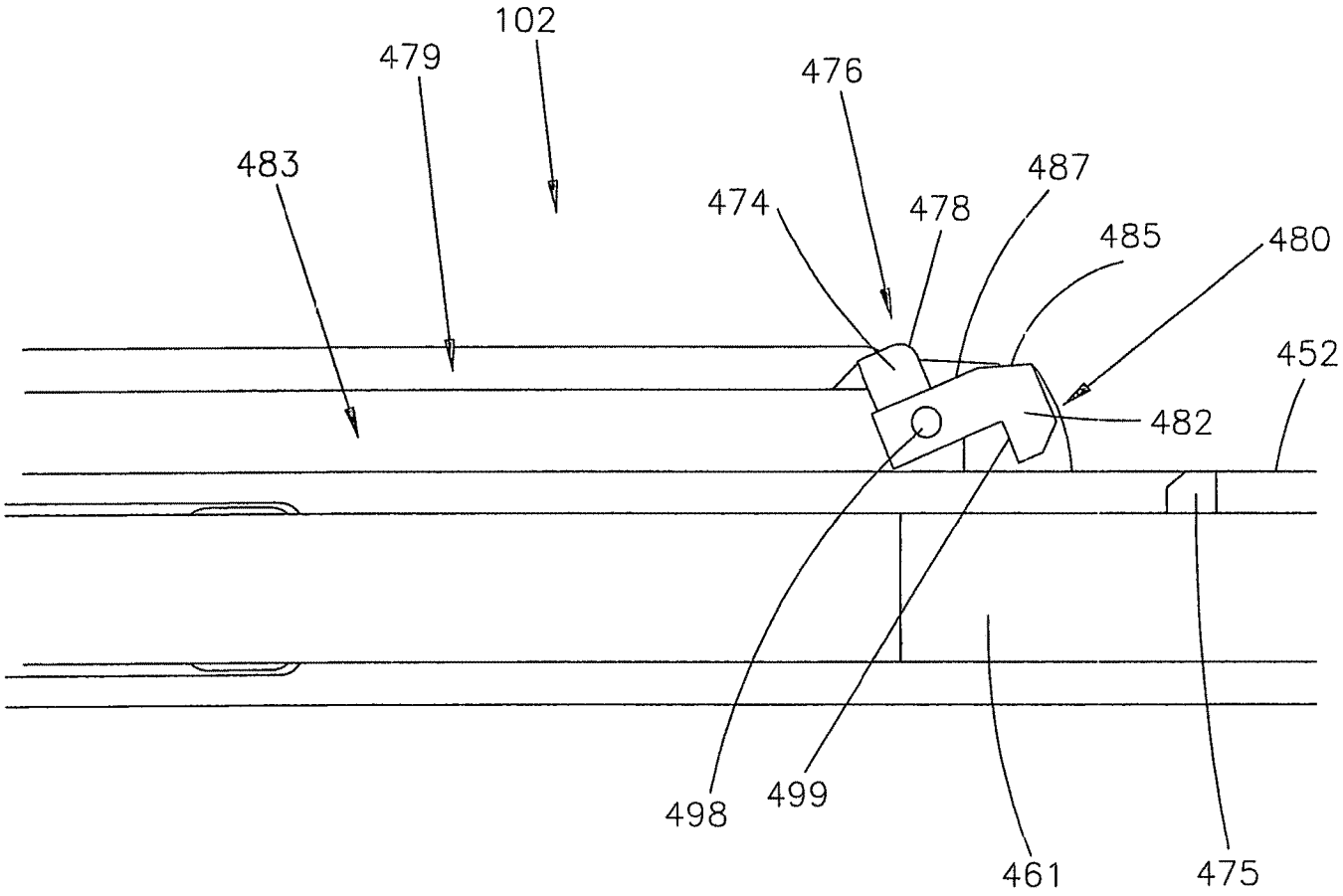
Figure 23:
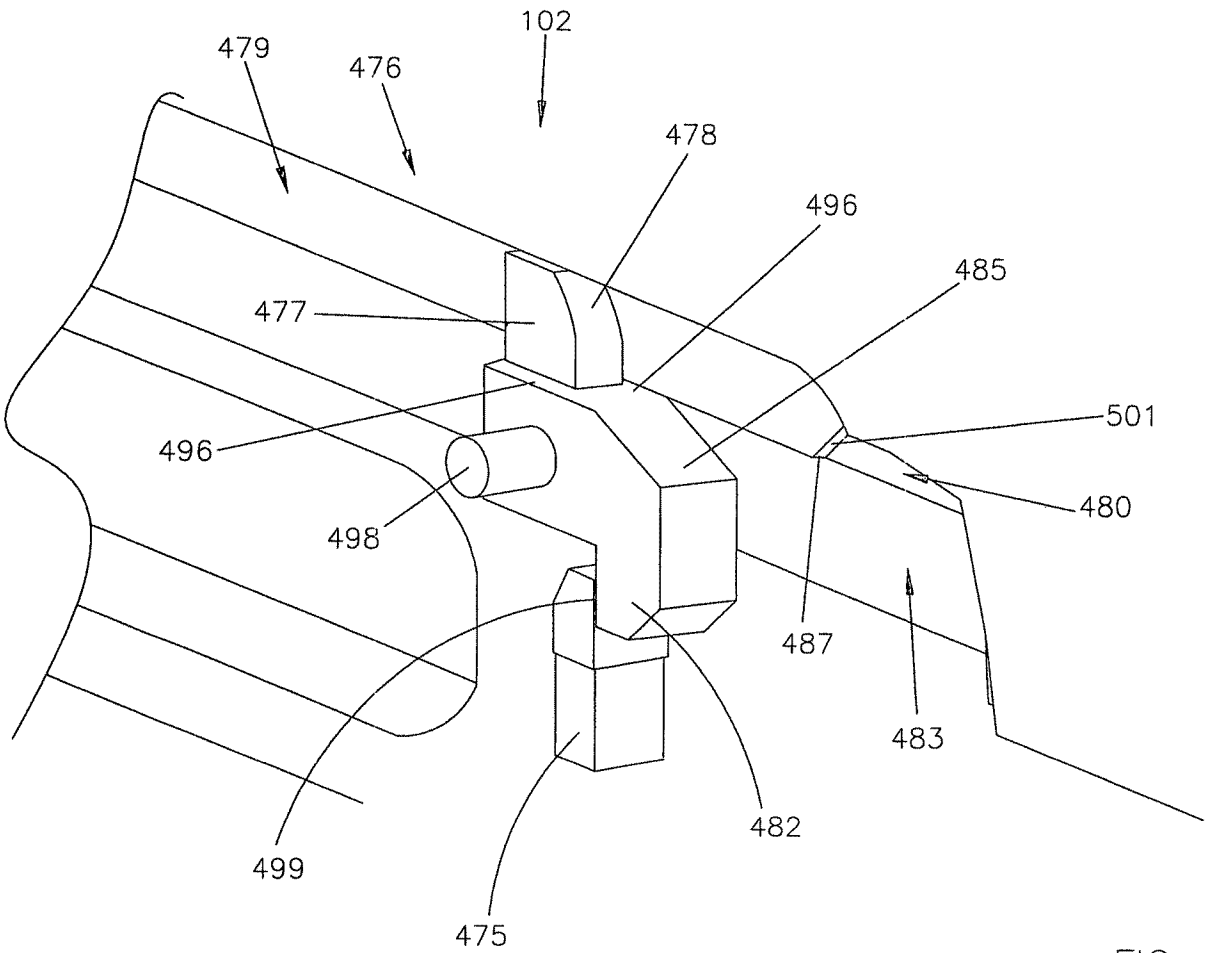

As shown in FIGS. 21 through 23, each bolt/bolt carriage locking mechanism comprises a coupling post 475 extending upwardly from the upper surface of each distal lateral member 461 into a substantially longitudinal slot 489 (FIGS. 16 and 17) formed through each hollow arm or member 452 of the bolt 416 and a latch generally indicated as 476 movable between a first or locked position and a second or unlocked position coupled to a latch mount 477 formed on the upper forward portion of the corresponding hollow arm or member 452 by a mounting pin or member 498 to selectively engage the corresponding coupling post 475 extending upwardly through the corresponding slot 489 from the corresponding distal lateral member 461 of the bolt carrier or carriage 418 when the latch 476 is in the first or locked position.

As shown in FIGS. 21 through 23, the latch 476 comprises a first or upper leg or element 474 including a first seating surface 478 such as a substantially arcuate or convex surface formed between the top edge or surface and the leading edge or surface thereof disposed within a substantially longitudinal inner groove having a narrow proximal section or segment 479 and a wide distal section or segment 480 formed in the lower portion of the upper receiver 102 to engage a first or substantially concave seat 481 formed in the distal end portion of the narrow proximal section or segment 479 when the latch 476 moves from the locked or first position to the unlocked or second position as the bolt assembly 408 advances toward the forward most or firing position to disengage the corresponding coupling post 475 and a second or lower leg or element 482 including a second seating surface 485 such as a substantially flat surface selectively disposed within a substantially longitudinal outer channel 483 formed in the lower portion of the upper receiver 102 and the wide distal section or segment 480 of the substantially longitudinal inner groove. A coupling post engaging surface 499 is formed on the rear portion of the second or lower leg or element 482 to engage the coupling post 475 when the latch 476 is in the first or locked position. The substantially longitudinal outer channel 483 is aligned with and open to the substantially longitudinal inner groove. A second substantially flat seat 496 is formed in the distal section or segment 480 of the substantially longitudinal upper groove adjacent the first seating surface 481 to engage the second substantially flat seating surface 485 of the second or lower leg or element 482 when the latch 476 moves from the locked or first position to the unlocked or second position as the bolt carrier or carriage 418 advances toward the forward most or firing position.

A substantially inclined or slanted surface 501 terminating in a latch cam surface 487 formed at the lower portion thereof is formed in each side wall of the upper receiver 102 between the wide distal section or segment 480 and the narrow proximal section or segment 479 to engage the upper surface 496 on each side of the latch 476 at the intersection or interface between the first or upper leg or element 474 and the second or lower leg or element 482 adjacent each side of the corresponding latch mount 477 as the bolt assembly 408 moves from the forward most or firing position to the rearward most or open bolt position to move or rotate the latch 476 from the unlocked position to the locked position to reengage the corresponding coupling post 475. The first seating surface 478 and first seat 481 cooperatively form a first latch seat arrangement; while, the second seating surface 485 and second seat 496 cooperatively form a second latch seat arrangement to retain the latch 476 in the second or unlocked position as the distal lateral members 461 extend and retract from the hollow arms or members 452.

The width of the first or upper leg or element 474 is less than the width of the proximal section or segment 479 and the width of the distal section or segment 480 as well as the width of the second or lower leg or element 482; while, the width of the second or lower leg or element 482 is less than the substantially longitudinal outer channel 483 and the distal section or segment 480 of the upper groove and greater than proximal section or segment 479. The upper surface 496 of the second or lower leg or element 482 adjacent each side of the first or upper leg or element 474 comprises a substantially flat cam surface to engage the inclined or slanted surface 486 and the cam surface 487 to return the latch 476 from the second or unlocked position to the first or locked position as the bolt assembly 408 moves from the forward most position to the rearward most position following firing.

As the width of the second or lower leg or element 482 is greater than the width of the proximal section or segment 479, the coupling post 475 pushes against the lower leg or element 482 causing the bolt 416 and bolt carrier or carriage 418 to travel forward together. Since the width of the distal section or segment 480 is greater than the width of the second or lower leg or element 482, the lower leg or element 482 rotates upward into the proximal section or segment 479 disengaging from the coupling post 475 as the first seating surface 478 engages the first seat 481 of the first latch seat arrangement and the second seating surface 485 engages the second seat 496 of the second latch seat arrangement allowing the bolt carrier or carriage 418 to continue forward as the bolt 416 remains in position. The first latch seat assembly and second latch seat assembly thus retain the latch 476 in the second or unlocked position as the distal lateral members 461 of the bolt carrier or carriage 418 extend and retract from the hollow arms or members 452 of the bolt 416 during the firing portion of the operation of the bolt driven gas operated machine gun 10.

In other words, the latch 476 is moved from the first or locked position to the second or unlocked position as the bolt assembly 408 moves forward to the forward most or closed bolt position, unlocking or disengaging the coupling post 475 of the bolt carrier or carriage 418 from the latch 476 of the bolt 416 allowing the distal lateral members 461 of the bolt carrier or carriage 418 to extend from the corresponding hollow arm or member 452 of the bolt 416 to advance or move the hollow substantial cylindrical sleeve 428 of the firing chamber positioning mechanism 409 forward to rotate the firing chamber 420 locking the bolt 418 and firing chamber 420 in the firing position.

Upon firing, the bolt carrier or carriage 418 moves rearwardly until the coupling post 475 engages the rear surface of the longitudinally disposed slot 489 formed through the yoke of the bolt 416 coupling the bolt 416 and bolt carrier or carriage 418 together.

As the bolt assembly 408 moves from the forward most position or closed bolt position rearwardly the distal lateral members 461 of the bolt carrier or carriage 418 retract into the corresponding hollow arm or member 452 as the hollow substantially cylindrical sleeve 428 of the firing chamber positioning mechanism 409 moves rearward rotating the firing chamber 420 unlocking the bolt 418 and firing chamber 420 from the firing position.

As the coupling post 475 moves the bolt assembly 408 rearward, the latch 476 is moved to the first or locked position to the second or unloaded position as the upper surfaces 496 of the corresponding second or lower leg or elements 482 engage the corresponding latch cam surfaces 487.

In summary, the sequence of operation is essentially the same as that described in the first embodiment.

As shown in FIGS. 15 through 20, the gun feed mechanism of the alternate embodiment generally indicated as 510 comprises a bolt driven assembly disposed in operative relationship to a magazine drive mechanism (not shown) of the ammunition magazine 415 to feed cartridges 22 to a cartridge feed opening 511 (FIG. 1) formed in the lower receiver 104 of the gas operated machine gun 10.

The gun feed mechanism 510 comprises an input drive assembly and an output drive assembly selectively coupled by an intermediate drive assembly to feed cartridges 22 from the ammunition magazine 415 through the cartridge feed opening 511 as the bolt assembly 408 moves rearwardly under the force of the distal bolt positioning mechanism 411. Specifically, the input drive assembly comprises the input or linear drive assembly generally indicated as 512 such as a rack including a plurality of teeth generally indicated as 514 coupled to or formed in the bolt 416 of the bolt assembly 408. The intermediate drive assembly generally indicated as 515 comprises a rotational drive assembly including a first intermediate member 516 such as a substantially circular gear or disk member with teeth formed on the outer surface thereof affixed or mounted on a shaft 519 attached or coupled to the lower receiver 104 disposed to engage the plurality of teeth 514 of the rack 512, a second intermediate member 517 such as a beveled gear with a plurality of teeth formed on the periphery thereof affixed or mounted on the shaft 519 and a third intermediate member 518 such as a beveled gear with a plurality of teeth formed on the periphery thereof to engage the plurality of teeth of the second intermediate member 517. The output drive assembly generally indicated as 520 includes a substantially circular gear or disk member 522 having a plurality of teeth formed on the periphery thereof partially enclosed in a protective housing 524. The substantially circular gear or disk member 522 is disposed to engage the upper magazine drive assembly 24 of the magazine feed assembly to cooperatively translate the linear motion of the bolt 416 of the bolt assembly 408 during operation of the bolt driven gas operated machine gun 10 to rotational motion to feed cartridges 22 from the ammunition magazine 415 to the bolt driven gas operated gun 10.

The gear feed mechanism 510 further comprises a clutch assembly generally indicated as 526 including a clutch release mechanism to selectively release the third intermediate member 518 of the intermediate drive assembly 515 to engage the substantially circular gear or disk 522 of the output drive assembly 520 as the bolt carrier or carriage 418 of the bolt assembly 408 moves forward under the force of the compression springs or bias 470 of the proximal bolt positioning mechanism 410 and a clutch disengagement mechanism to disengage the output drive assembly 520 from the third intermediate member 518 of the intermediate drive assembly 515 as the bolt 416 of the bolt assembly 408 moves rearwardly under the force of the piston rods 132 and gas powered pistons (not shown) of the distal bolt positioning mechanism 411.

Specifically, as the bolt assembly 408 and bolt carrier or carriage 418 move forward under the force of the proximal bolt assembly positioning mechanism 410 a rear bolt cam 527 formed on the lower rear portion bolt carrier or carriage 418 engages a first clutch member or housing 528 normally biased in an upper position by a bias or spring 530 disposed within a recess (not shown) found in the lower receiver 104 forcing the first clutch member 528 downward moving a clutch member retention assembly comprising a catch or latch member 532 attached to the clutch recess 534 formed in the clutch body 536 to selectively retain the catch or latch member 532 when in the locked position from a first or locked position to a second or unlocked position allowing a substantially horizontally disposed bias or spring 538 to release the third intermediate member 518 of the intermediate drive assembly 515 into operative engagement with the substantially circular gear or disk 522 of the output drive assembly 520.

It should be noted that since the bolt 416 is in the forward most position when the clutch is released, there is no movement of the rack 312 and therefore no rotatory movement in the gun feed mechanism 510.

Upon firing, initially the bolt carrier or carriage 418 moves rearwardly until the coupling post 475 engages the rear surface of the longitudinally disposed slot 489 formed through each corresponding hollow arm or member 252 of the bolt 416 causing the bolt 416 and bolt carrier or carriage 418 to move rearwardly together. Since the clutch assembly 526 is engaged, the rack 312 on the bolt 416 rotates the substantially circular gear or disk member 522 engaged to the magazine feed assembly to feed a cartridge 22 to the lower receiver 104 translating the linear motion of the bolt 418 and bolt assembly 408 into the rotational motion of the intermediate drive assembly 515 and the output drive assembly 520 to drive the magazine drive gear of the magazine feed assembly.

As the bolt 416 and bolt assembly 408 continue to move rearward under the force of the distal bolt assembly positioning mechanism 411 after firing a round, a forward bolt clutch member 540 formed on the lower portion of the bolt 416 engages a clutch disengagement member 542 moving the clutch member retention assembly to the first or locked position. That is, the third intermediate member 518 of the intermediate drive assembly 515 is disengaged from the circular gear or disk 522 of the output drive assembly 520 and forcing the catch or retainer member 532 into the clutch recess 534 securing the intermediate drive assembly 515 in the disengaged position until the clutch release mechanism again releases the clutch as previously described.

An alternate embodiment may include a ratchet wheel and spring biased clutch control.

Figure 24:
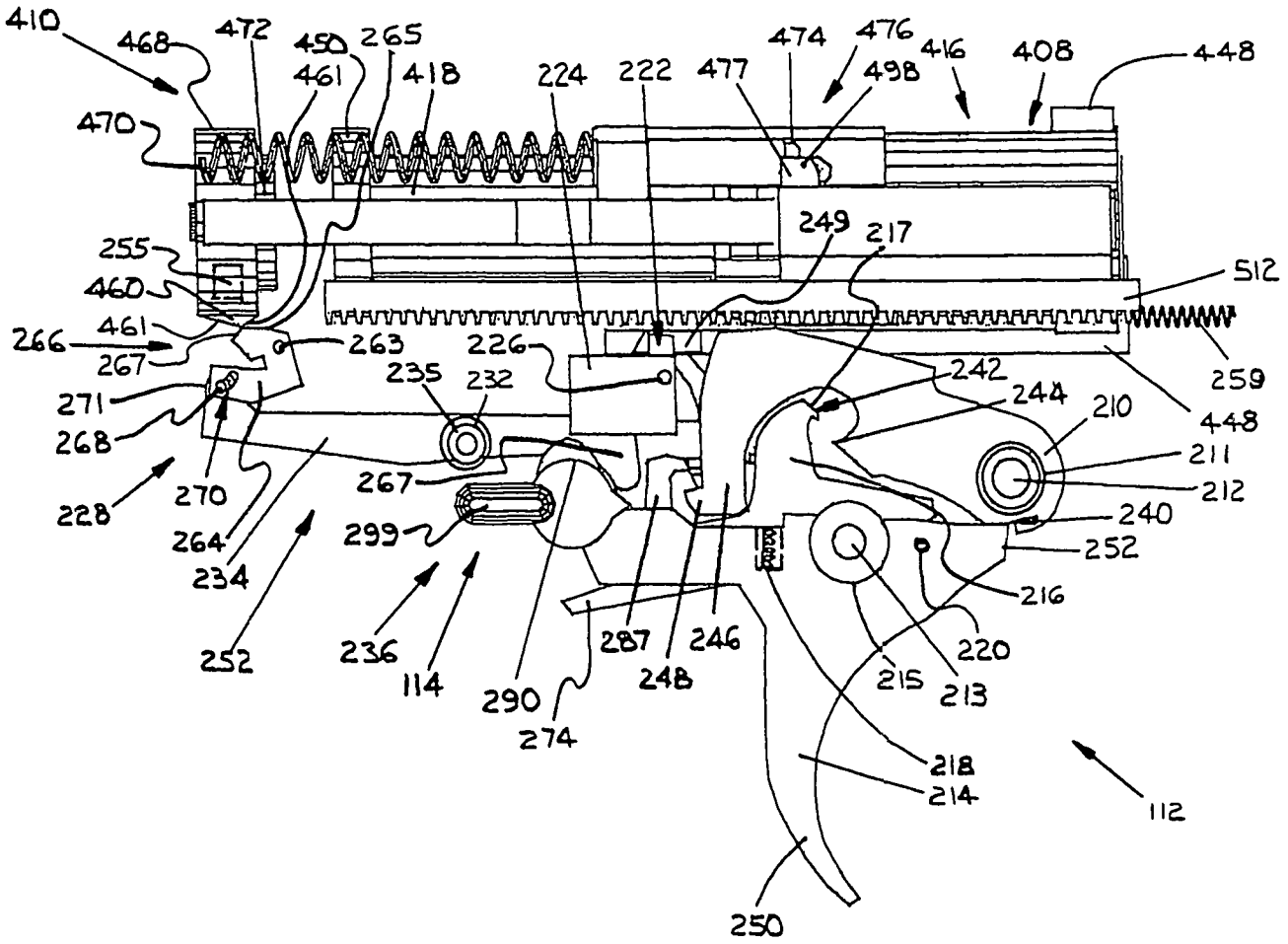
FIGS. 24 through 32 show the firing mechanism and sear assembly of the alternate embodiment of the present invention.

As previously stated, the bolt driven gas operated machine gun 10 is operable in a semi-automatic mode or fully automatic mode controlled by a firing mode mechanism or selector. As shown in FIGS. 24 through 336, the firing mechanism 112 comprises a hammer 210 pivotally coupled to the frame or lower receiver 104 by a pivot pin 212 normally biased to the vertical or firing position by a spring or similar bias device 211 and a trigger 214 pivotally coupled to the frame or lower receiver 104 (FIG. 1) by a pivot pin 213 normally biased in the released or forward position by a spring or similar bias device 215.

Figure 25:
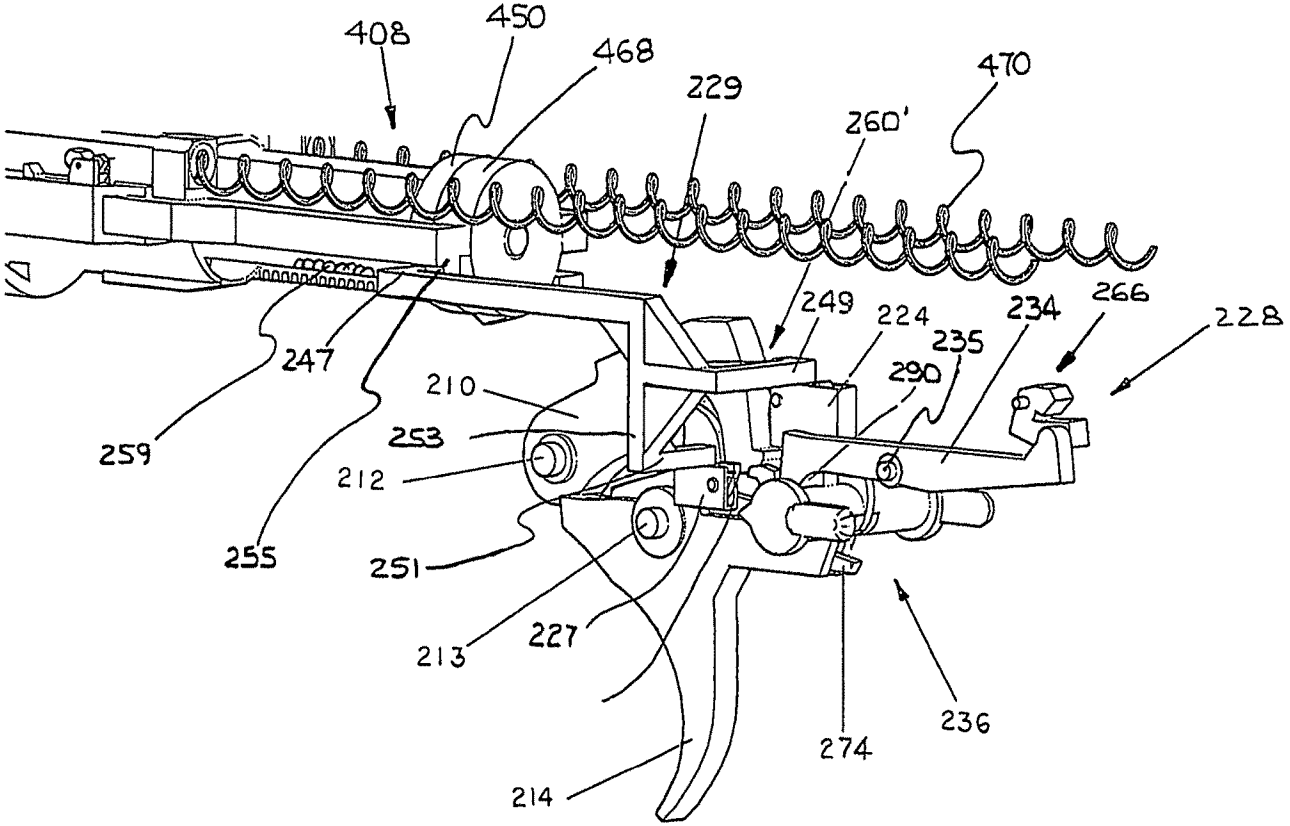

As shown in FIGS. 24 and 25, the sear assembly 114 comprises a trigger sear 216 including a sear tip 217 normally biased forward by a spring or other bias device 218 or similar bias device and a trigger sear limit pin or stop 220 to limit forward rotation of trigger sear 216 relative to trigger 214 pivotally coupled on the pivot pin 215 with the trigger 214 to the frame or lower receiver 104, an auto-sear assembly including an auto-sear generally indicated as 222 rotatably disposed within an auto-sear housing 224 by a pivot pin 226 and a trigger blocking mechanism generally indicated as 227 and an auto-sear actuator or positioning mechanism generally indicated as 229, and a bolt sear assembly assembly generally indicated as 228.

Figure 26:
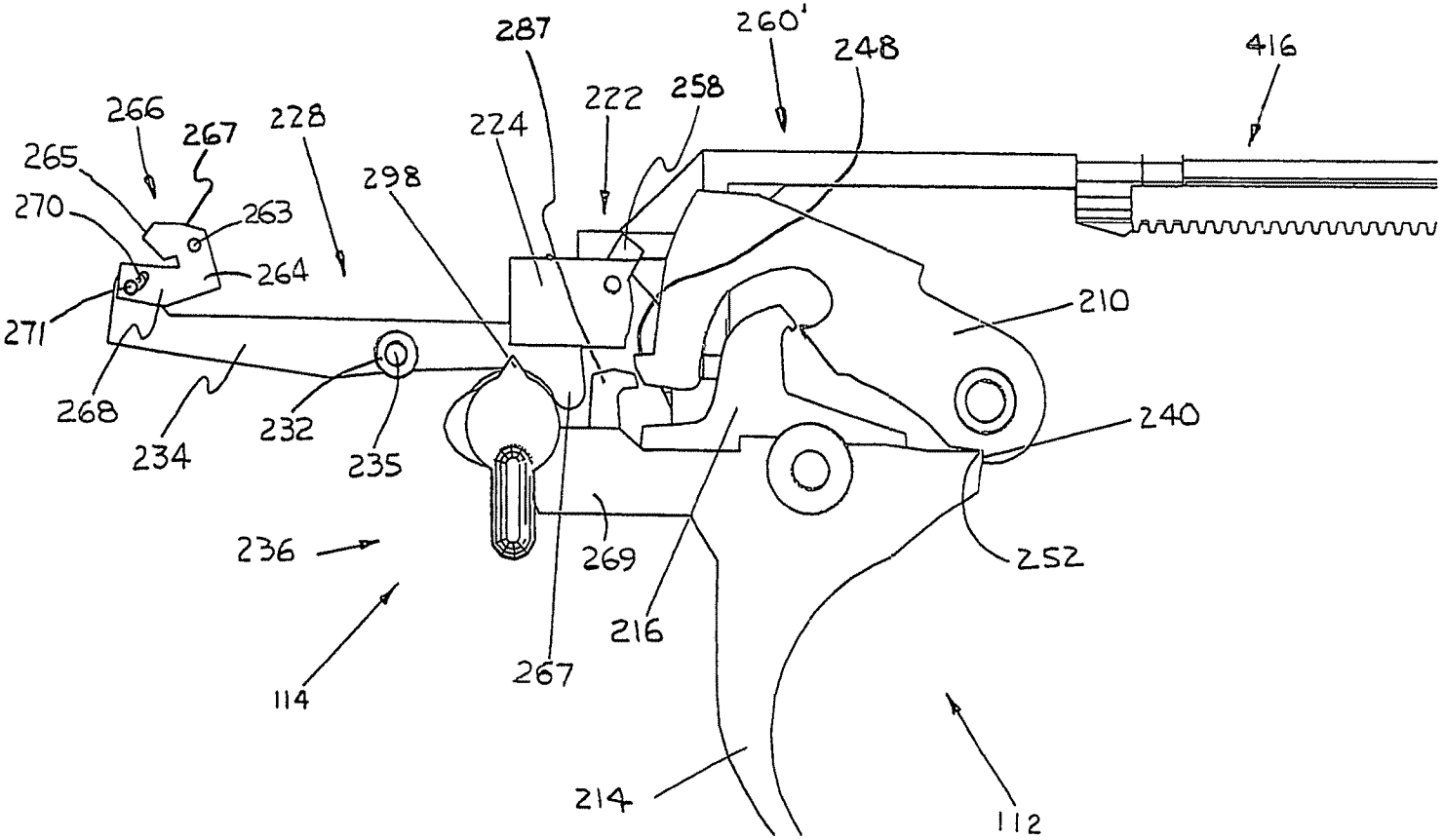
Figure 31:
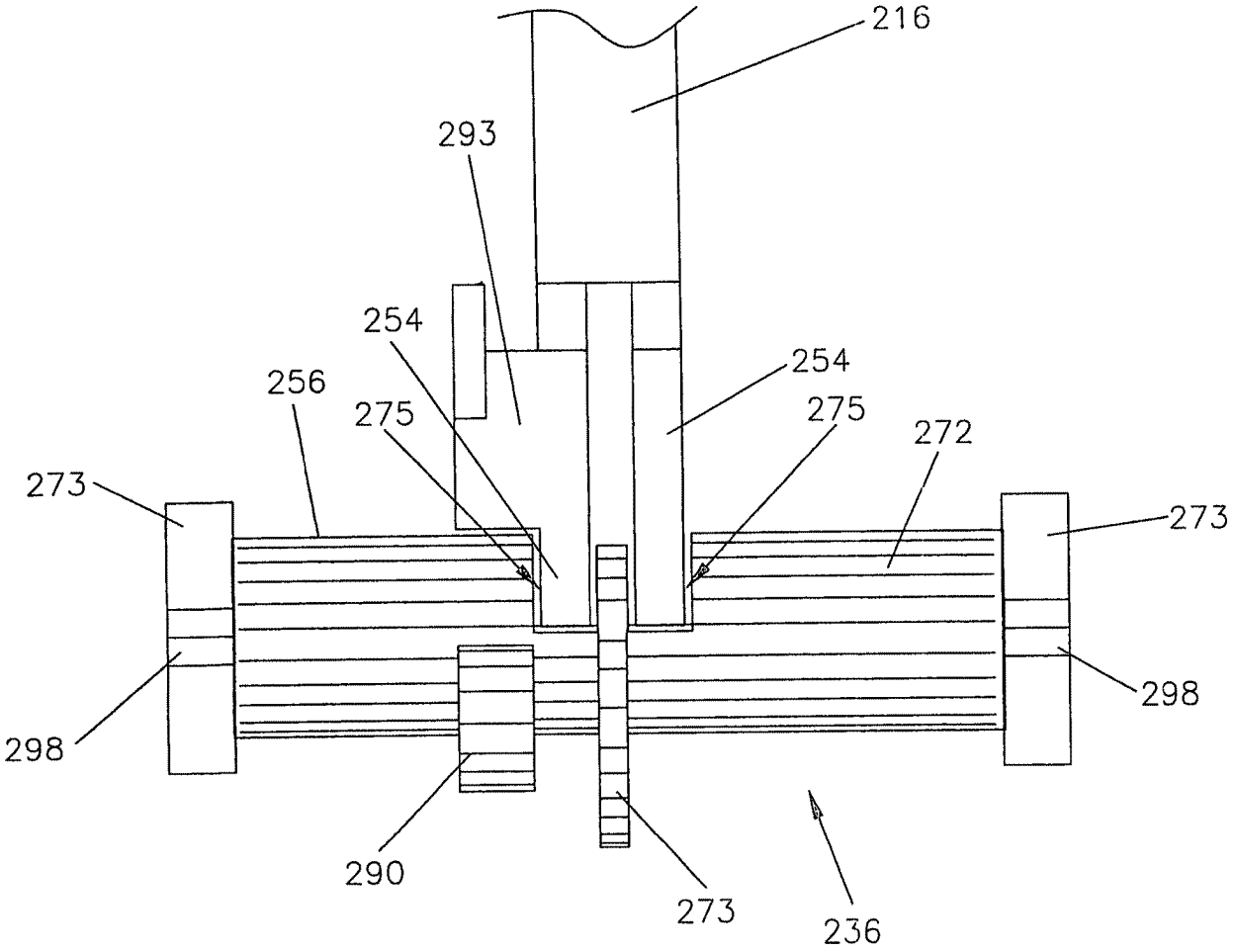

As shown in FIG. 31, firing mode mechanism or selector generally indicated as 236 is rotatably mounted to the frame or lower receiver 104 to selectively control operation of the bolt driven gas operated machine gun 10 in a safety (safe) mode (FIGS. 24 and 25), semi-automatic mode (FIGS. 26 and 27) or automatic mode (FIGS. 28 and 29) as described hereinafter.

Figure 28:
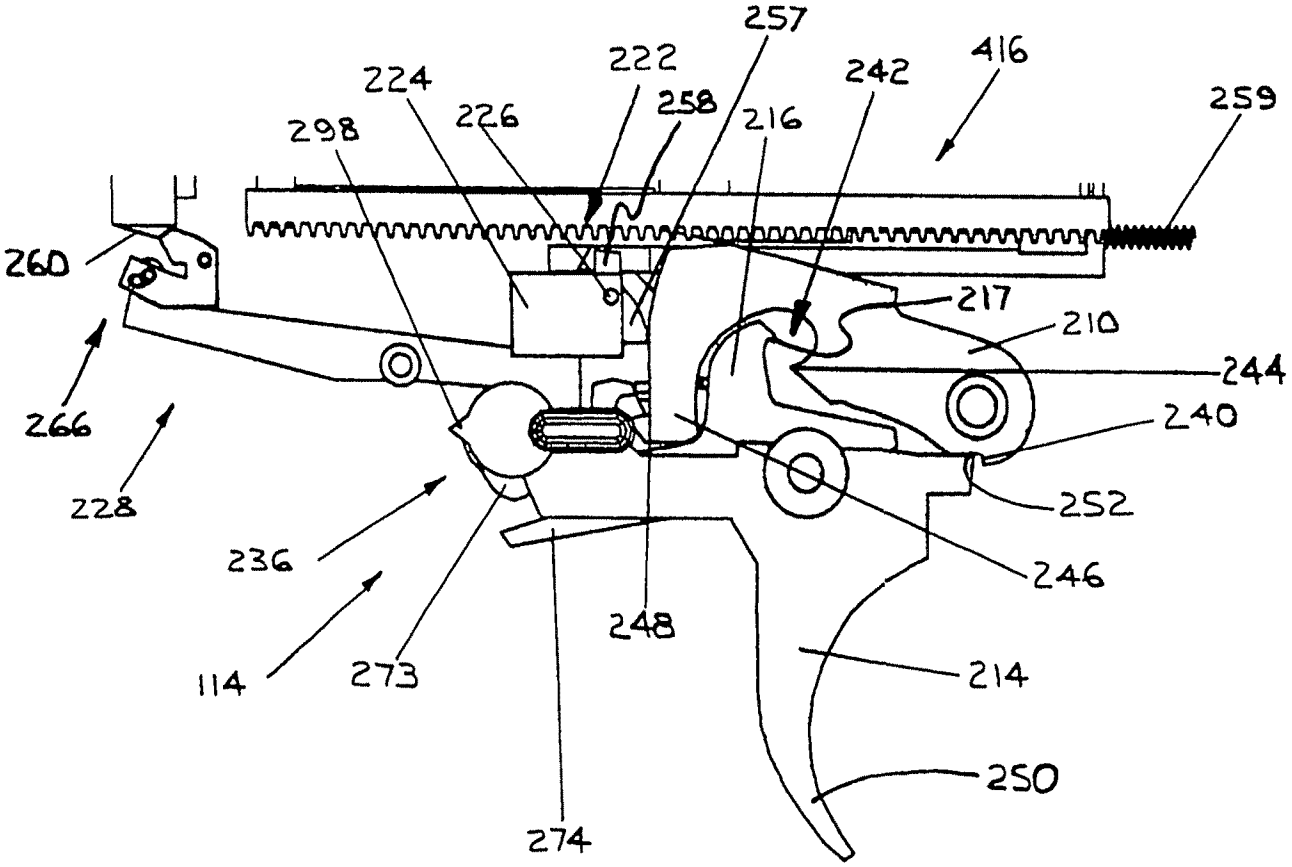

As shown in FIGS. 24 and 28, the hammer 210 includes a hammer retainer member or notch 240 to selectively engage a hammer retainer member 252 of the trigger 214, a sear receiving recess 242 having a first hammer sear member or tip 244 to selectively engage the trigger sear tip 217 of the trigger sear 216 when operating in the semi-automatic mode and a sear member 246 having a second hammer sear member or notch 248 to selectively engage the auto-sear 222 when operating in the automatic mode.

As shown in FIGS. 24 and 28, the trigger 214 includes a finger engaging member or pull 250 and the hammer lock member 252 to selectively engage the hammer retainer notch 240 to hold or retain the hammer 210 in place when the trigger 214 is not pulled when in the safety mode or the semi-automatic mode.

As shown in FIG. 31, the rear portion of the trigger 214 further includes a pair of trigger extensions each indicated as 254 to engage a surface 256 of the firing mode selector 236 when in the safety (safe) position (FIGS. 24 and 25) to prevent the bolt driven gas operated machine gun 10 from firing.

Figure 29:
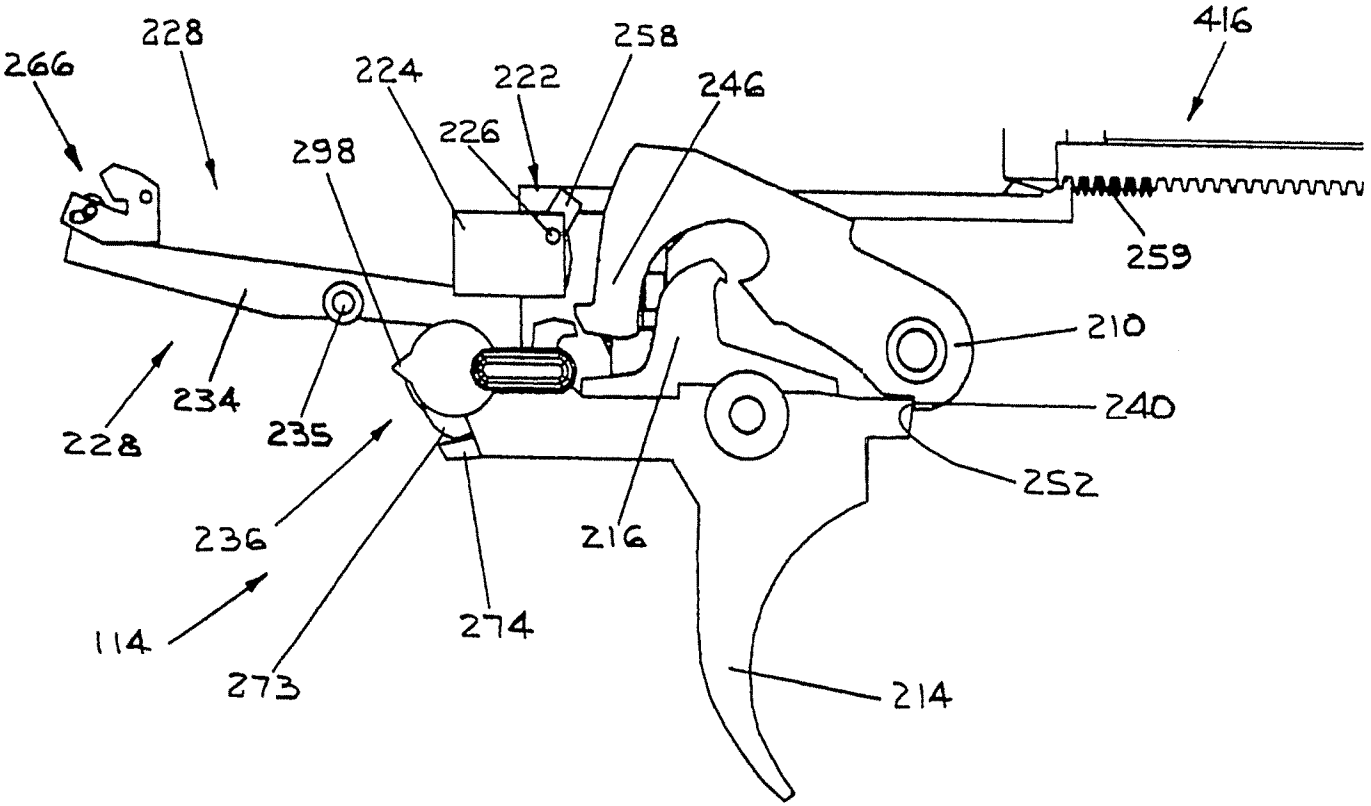
Figure 30:
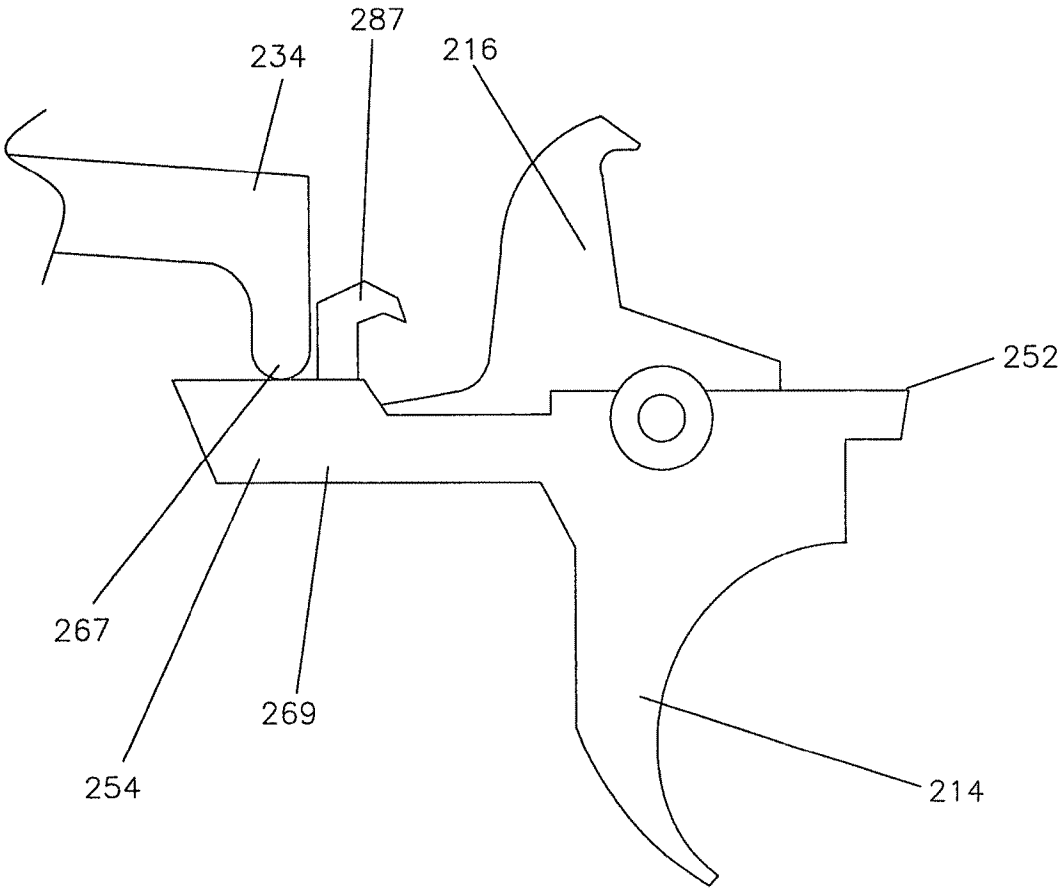
Figure 32:
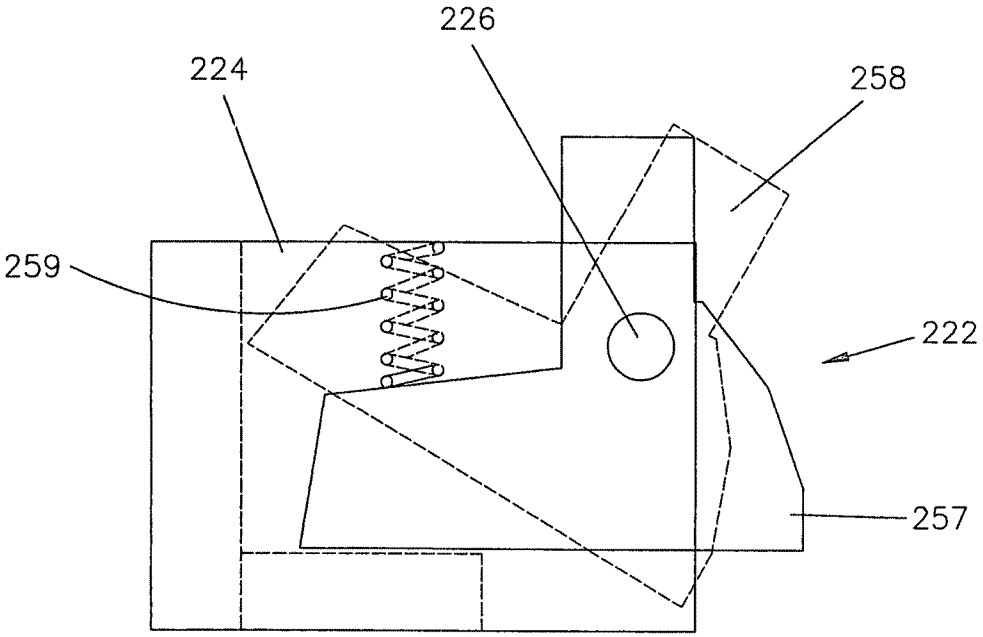

As best shown in FIGS. 28, 29 and 32, the auto-sear 222 comprises a sear member at least partially disposed within the auto-sear housing 224 movable between a first or lock position (solid lines) and a second or unlock position (phantom lines) normally biased in the first or lock position by a bias 259 such as a spring or similar device. The sear member includes a hammer engaging sear 257 and a sear actuator or positioning member 258 to selectively engage the second sear member or notch 248 formed on hammer 210 when operating in the automatic mode.

Figure 33:
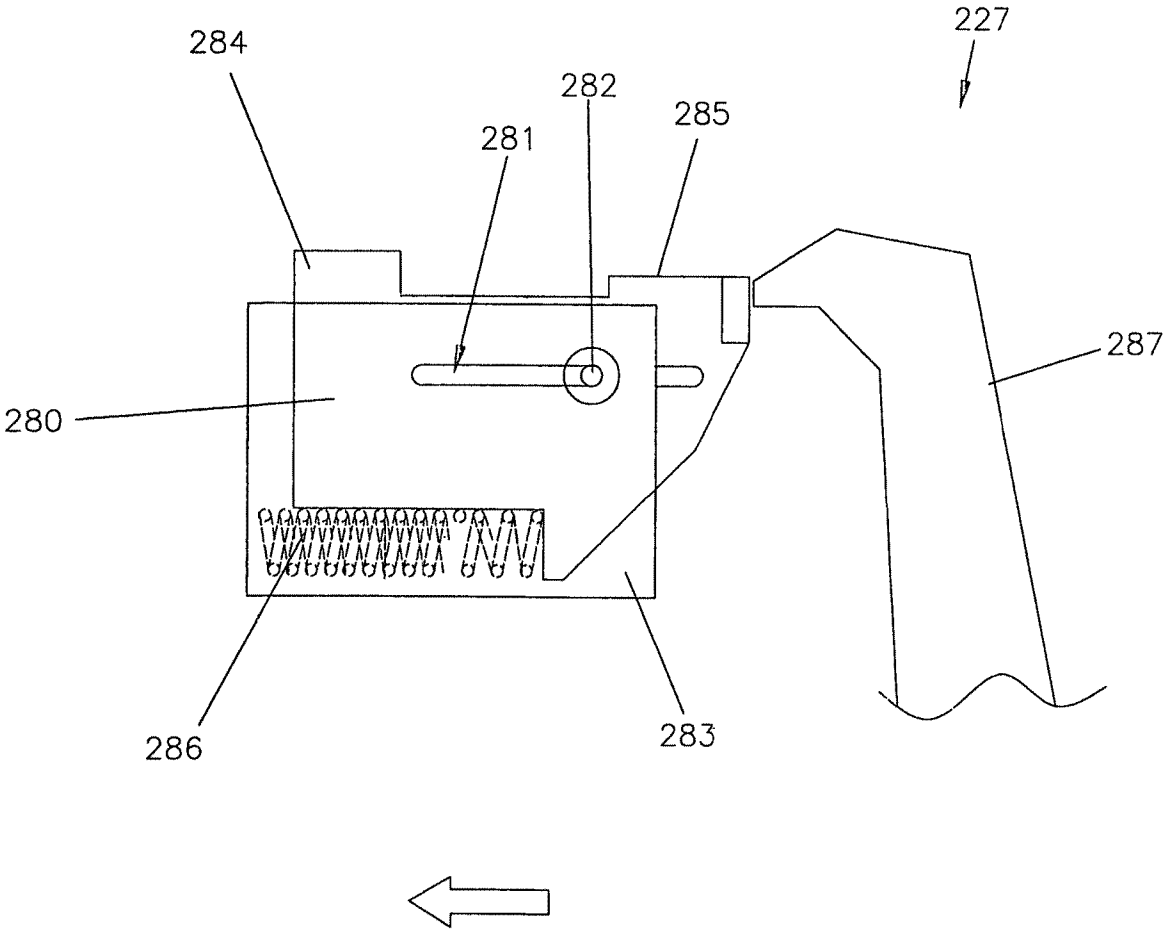
FIGS. 33, 33A and 33B show side views of the trigger blocking mechanism of the present invention.
Figure 33A:
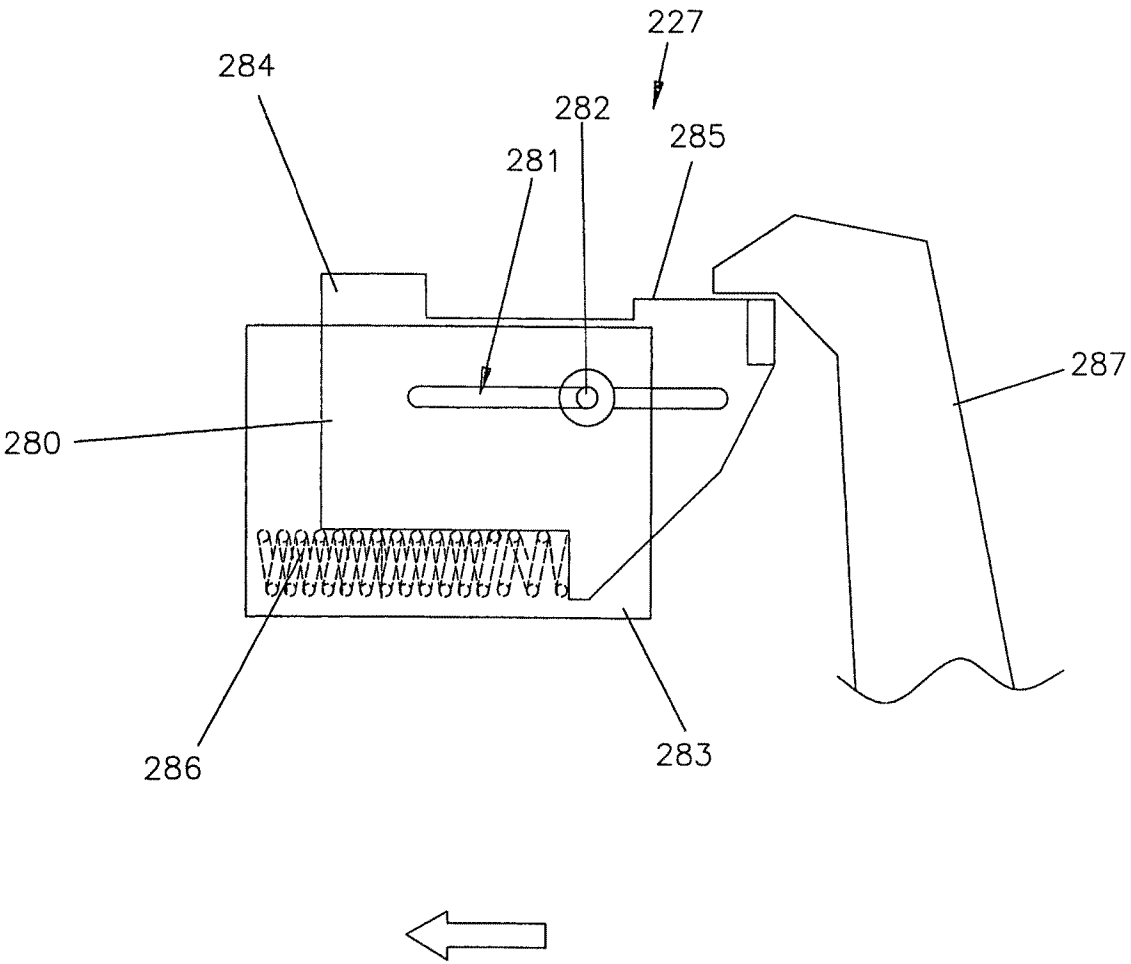
Figure 33B:
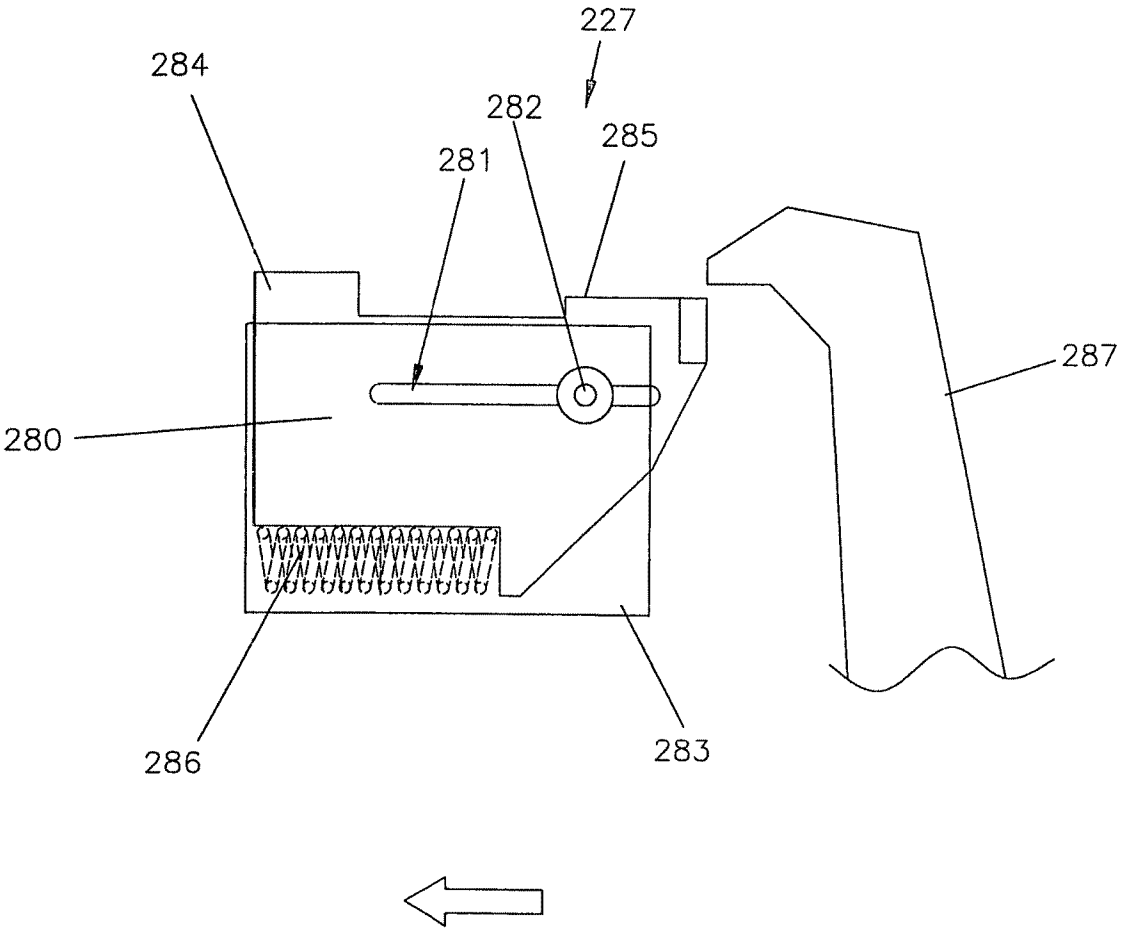

As shown in FIGS. 25 and 33 through 33B, a trigger blocking mechanism 227 is disposed to selectively engage the trigger 214 when squeezed or pulled to insure the firing cycle is complete when operating in the automatic mode to maintain the bolt driven gas operated gun 10 in the open bolt configuration.

As best shown in FIGS. 33 through 33B, the trigger blocking mechanism 227 comprises a latch member or slide 280 movable between an intermediate position when the bolt driven gas operated machine gun 10 is in the automatic mode and open bolt configuration and the trigger in the released or forward position (FIG. 33), a rear or proximal position (FIG. 33A) when the trigger 214 is pulled as the bolt assembly 408 is released from the bolt assembly sear 228 and a forward or distal position (FIG. 33B) as the auto-sear actuator or positioning mechanism moves from the rear or proximal position to the forward or distal position by the bolt assembly 408 moving from the open bolt position to the closed bolt position. The latch member or slide 280 includes a slot 281 to receive a pin 282 extending inwardly in a latch housing 283. The latch member or slide 280 includes a distal slide actuator or positioning member 284 and a proximal trigger catch or limit member 285 normally biased rearwardly within the latch housing 283 by a bias or spring 286 (FIG. 33). With the trigger 214 is in the released position, a hook or an inverted substantially L-shaped catch or stop member 287 engages the rear or proximal surface of the proximal catch limit member 285 to retain the latch member or slide 280 in an intermediate position (FIG. 33).

In addition, the hook or inverted substantially L-shaped catch or stop member 287 of the trigger 214 rotates upwardly to disengage the latch member or slide 280 allowing the bias 286 to move the latch member or slide 280 rearward to the proximal position beneath the trigger 214 (FIG. 33A) to prevent the trigger 214 from releasing or moving downward under the force of bias or spring 215, at the same time releasing or disengaging the hammer retainer notch 240 of the hammer 210 from the hammer retainer member 252 of the trigger 214 allowing the hammer 210 to rotate upwardly under the force of bias 211 such that the second hammer sear member or notch 248 engages the hammer engaging sear 257 of the auto-sear 222 to the first or locked position.

Figure 27:
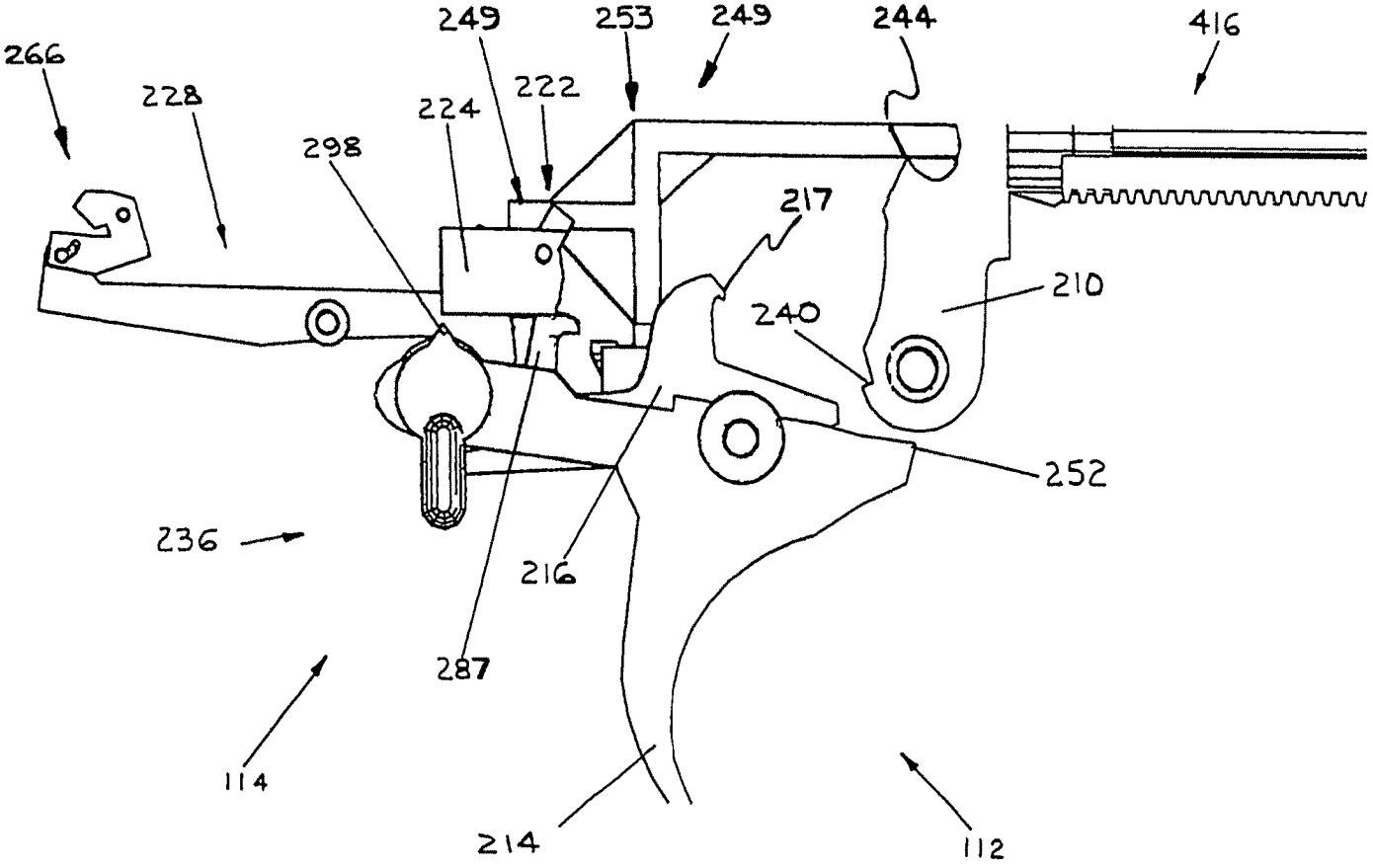

As best shown in FIGS. 25 and 27, the auto-sear actuator or positioning mechanism 229 comprises an upper auto-sear hammer actuator or member 249 disposed to selectively engage the sear actuator or positioning member 258 and a lower trigger blocking actuator or member 251 disposed to selectively engage the distal slide actuator or positioning member 284 interconnected by an interconnecting member generally indicated as 253 including a bolt carriage engagement projection or protrusion 247 to selectively engage a bolt carriage engagement member 255 attached to the bolt carrier or carriage 418 as the bolt assembly 408 moves forward during the during cycle to clear the hammer engaging sear 257 from the path of the hammer 210 as the hammer 210 rotates forward when the trigger 214 is pulled or held back and the bolt 216 and the firing chamber 420 are locked together.

The auto-sear actuator or position mechanism 229 is biased rearwardly by a bias or spring 259 that extends between the frame or lower receiver 104 and the auto-sear actuator or positioning mechanism 229.

As best shown in FIGS. 24 through 30, the bolt assembly sear 228 comprises an elongated bolt assembly sear positioning member or connector 234 pivotally coupled to the frame or lower receiver 104 by a pivot pin 235. The elongated bolt assembly sear positioning member or connector 234 is normally biased to rotate forward by a spring 232 or other bias device. The bolt sear assembly positioning member or connector rod 234 includes a proximal bolt assembly locking or retaining mechanism generally indicated as 266 movably coupled to the proximal end thereof and a trigger engaging projection 267 formed on the distal end portion thereof to engage the rear portion 269 of the trigger 214 (FIG. 31) when in the automatic mode and the trigger 214 is pulled or held back.

The proximal bolt assembly locking or retaining mechanism 266 comprises a first leg or member 264 pivotally coupled to the frame or lower receiver 104 by a pin 263 having a bolt assembly locking or stop surface or face 265 and a bolt assembly cam 267 formed thereon and a second leg or member 268 having a bolt assembly cam slot 270 to receive a positioning pin 271 extending outwardly from the first leg or member 264 such that the rear bolt cam or face 265 and the rear bolt assembly locking or stop surface or leading face 461 of the bolt assembly projection or protrusion 260 selectively engage when operating in the automatic mode to lock or secure the bolt assembly 408 in the open position when the trigger 214 is released.

When the trigger 214 is pulled or squeezed the bolt assembly locking or stop surface or face 265 of the proximal bolt assembly locking or retaining member or mechanism 266 is rotated out of engagement with the rear bolt assembly protrusion 260 by the first leg or member 264 as the forward or distal end of the connector rod or member 234 is rotated upwardly by the trigger 214 moving the positioning pin 271 along the proximal rear bolt assembly slot 270 since the pivot pin 230 is disposed within a recess (not shown) formed in the frame or lower receiver 104 allowing the bolt assembly 408 to travel forward under the force of the proximal bolt positioning mechanism or bolt assembly positioning mechanism 410.

As shown in FIG. 31, the firing mode selector 236 comprises a substantially cylindrical body 272 having a manual finger actuator 273 including a mode indicator or pointer 298 formed on each end thereof. A pair of slots or grooves each indicated as 275 are formed in the surface 256 of the substantially cylindrical body 272 to receive the trigger extensions 254 when operating in the semi-automatic mode or automatic mode when the trigger 214 is pulled or squeezed. When in the safe or safety mode, the trigger extension 254 engages the surface 256 of the substantially cylindrical body 272 when the trigger 214 is pulled or squeezed preventing firing of the bolt driven gas operated machine gun 10. As shown from the top view in FIG. 31, the firing mode selector 236 is in the semi-automatic mode position with the mode indicator or pointer 298 perpendicular to the longitudinal axis of the bolt driven gas operated machine gun 10.

As shown in FIG. 31, the firing mode mechanism or selector 236 includes a plurality of lobes to control the mode of operation. In particular, a first lobe 290 is disposed to engage the forward portion of the connector rod or member 234 when the firing mode selector 236 is in the semi-automatic mode to elevate the portion of the elongated bolt assembly sear positioning member or connector 234 against the force of the spring 232 to disengage the rear bolt cam 260 from proximal bolt assembly locking or retaining member or mechanism 266. A second lobe 277 is disposed to engage the rear portion 274 of the trigger sear 216 rotating the trigger sear 216 out of position to clear the sear receiving recess 242 and out of operative relationship relative to the first hammer sear member or tip 244 when operating in the automatic mode.

The connector rod or member disengagement element 292 engages the trigger release 293 as the connector rod as 234 rotates downward when the bolt assembly 408 is released.

As the bolt assembly 408 moves or travels forward a lower trigger release member 487 attached to the rear bolt sear extension 260 engages the rear bolt sear extension 260 engaging the distal actuator member 281 to move the latch member 280 forward to the distal position disengaging the proximal trigger catch limit member 282 from the hook or inverted substantially L-shaped catch 285 as the hammer 210 is released by the rotation of the sear actuator member 258 of the auto-sear 222 by the upper auto-sear actuator 249 (FIG. 33C).

The upper auto-sear hammer actuator 249 and the lower trigger blocking actuator 257 of the auto-sear actuator mechanism 216 are coupled to the frame or lower receiver 104 by the longitudinally disposed actuator arm or member 253. The auto-sear actuator or positioning mechanism 229 is normally biased rearward by a bias or spring 231 disposed longitudinally between the frame or lower receiver 104 and the longitudinally disposed actuator arm or member 253.

When operating in the automatic mode with the trigger 214 pulled or squeezed the lower latch member or slide 280 is disposed beneath the inverted substantially L-shaped catch or member 287 preventing release of the trigger 214 until the second hammer sear member or notch 248 is released from the hammer engaging sear 257 so that hammer retention latch 240 cannot engage or catch the hammer lock member 252 of the trigger 214.

The rear bolt assembly protrusion 460 comprises the leading edge or surface 461 and a trailing edge or surface 463 to selectively engage the rear bolt assembly lock or stop surface or face 267 and the rear bolt cam or face 265 of the first arm or member 264 of the bolt retainer sear 266 respectively as the bolt assembly 408 moves from the distal position to the proximal position and proximal position to distal position respectively.

Generally, barrels and upper receivers are constructed of steel or metal alloys and have several limitations, particularly for rapid fire weapons. These limitations include excess weight, high heat retention times and may begin to warp at temperatures in excess 900° F.

Thus, alternative materials are preferable. For example, a barrel and upper receiver constructed of carbon ceramics would be more preferable.

Ceramic matrix composites (CMC) consist of ceramic fibers embedded in a ceramic matrix, forming a ceramic fiber reinforced ceramic (CFRC) material. The fibers and matrix can consist of any ceramic material, therefore carbon and carbon fiber can also be considered a ceramic material. The barrel will be primarily comprised of carbon/silicon carbide (C/SiC), which is a carbon/carbon material. The ultimate tensile strength of the material is around 3500 mega-pascals (MPa), which is many times that of stainless steel (860 MPa). The material also has an extremely low thermal conductivity.

More particularly, Silicon nitride ($Si_3N_4$), Aluminum Oxide ($AL_2O_3$), and/or Silicon Carbide (SIC) combined with graphene has been shown to significantly increase the flexural and fracture toughness as well as high temperature strength and thermal shock toughness. That is, products constructed with such compounds exhibit extreme thermal conductivity as well as flexural and shock resistant properties.

Thus, to maximize the capability of the automatic weapons system, the barrel and even the upper receiver may be produced from a composition of $Si_3N_4$, $AL_2O_3$ and/or SIC infused with graphene at a ratio of about 0.5% to about 5% by weight or about 0.1% to about 2.0% by volume.

In comparison to steel or metal barrel(s) and upper receiver(s) construction, a barrel and upper receiver so constructed is significantly lighter in weight, as much as four (4×) times as strong as iron, has greater heat dissipation capabilities and is heat resistant up to 1800° F. and will not warp or wear, even through extended use.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

What is claimed is:

1. An automatic weapon system comprising:

a piston driven, gas operated machine gun including: a barrel assembly, a reciprocating bolt assembly, a firing chamber, and a firing chamber positioning mechanism;

wherein said reciprocating bolt assembly is movable between a rear or open position, an intermediate position and a forward or closed position by a bolt positioning assembly, wherein said firing chamber is movable between an unlocked position and a locked position relative to said reciprocating bolt assembly and wherein said firing chamber positioning mechanism is operatively coupled to an ammunition magazine to move said firing chamber between said unlocked position and said locked position and including a magazine feed mechanism and a cartridge feed opening by a gun feed mechanism to feed cartridges from said ammunition magazine to said piston driven gas operated machine gun, wherein said gun feed mechanism is disposed to engage said magazine feed mechanism to convert a linear motion of said reciprocating bolt assembly into rotary motion to feed a cartridge from said ammunition magazine through said cartridge feed opening into said firing chamber to be fired from said barrel assembly when said reciprocating bolt assembly is in a forward or closed position.

2. The automatic weapon system of claim 1 wherein said gun feed mechanism comprises a bolt driven assembly disposed in operative relationship to said magazine drive mechanism of said ammunition magazine to feed cartridges to said cartridge feed opening as said reciprocating bolt assembly moves rearwardly from said intermediate position to said rear or closed position.

3. The automatic weapon system of claim 2 wherein said gun feed mechanism comprises an input drive assembly and an output drive assembly selectively coupled by an intermediate drive assembly to feed cartridges from said ammunition magazine through said cartridge feed opening as said reciprocating bolt assembly moves rearwardly from said intermediate position to said rear or open position under the force of said bolt positioning assembly.

4. The automatic weapon system of claim 2 wherein said input drive assembly comprises a linear drive assembly formed on said reciprocating bolt assembly, said intermediate drive assembly comprises a rotational drive assembly movable between a first position and a second position disposed to engage said linear drive assembly of said input drive assembly and said output drive assembly comprises a rotational drive assembly disposed to engage said intermediate drive assembly when in said second position.

5. The automatic weapon system of claim 2 wherein said gun feed mechanism further comprises a clutch assembly including a clutch release mechanism to selectively release said intermediate drive assembly to engage said output drive assembly as said reciprocating bolt assembly moves forward under a force generated by a proximal bolt positioning mechanism and a clutch disengagement mechanism to disengage said output drive assembly from said intermediate drive assembly as said reciprocating bolt assembly moves rearwardly under said force of at least one piston rod and at least one gas powered piston of said bolt positioning assembly.

6. An automatic weapon system comprising a piston driven gas operated machine gun operable in either an open bolt configuration when operating in an automatic mode or a closed bolt configuration when operating in a semi-automatic mode and including an auto-sear mechanism to control operation of a trigger position and a hammer position, and a rear bolt sear mechanism to control position of a reciprocating bolt assembly, a reciprocating bolt assembly movable between a rear position or open position, an intermediate position and a forward or closed position by a bolt positioning assembly, and a firing chamber movable between an unlocked position and a locked position relative to said reciprocating bolt assembly by a firing chamber positioning mechanism operatively coupled to an ammunition magazine including a magazine feed mechanism and a cartridge feed opening by a gun feed mechanism to feed cartridges from the ammunition magazine to said piston driven gas operated machine gun.

7. The automatic weapon system of claim 6 including a auto-sear actuator mechanism movable between a proximal or rear position and a distal or forward position disposed to engage said bolt assembly moving from said rear or proximal position to said forward or distal position to move said auto-sear from said locked position to said unlocked position to release said hammer to fire said bolt driven gas operated gun when said bolt and said firing chamber are locked.

8. The automatic weapon system of claim 7 further including a trigger blocking mechanism movable between a trigger blocking position when said trigger is pulled when operating in the automatic mode, said auto-sear actuator mechanism disposed to engage said trigger blocking mechanism to release said trigger when said bolt assembly moves from said rear or proximal position to said forward or distal position as said hammer is released.

9. The automatic weapon system of claim 6 including a rear bolt assembly sear mechanism disposed to engage said bolt assembly to retain said bolt assembly in the rear or proximal position with the bolt open when said trigger is released when operating in the open bolt configuration.

* * * * *